US007192680B2

(12) United States Patent
Yau et al.

(10) Patent No.: US 7,192,680 B2
(45) Date of Patent: Mar. 20, 2007

(54) METHOD OF COATING A MULTILAYERED ELEMENT

(75) Inventors: Hwei-Ling Yau, Rochester, NY (US); James L. Johnston, Rochester, NY (US); Yongcai Wang, Webster, NY (US); John L. Pawlak, Rochester, NY (US); Douglas H. Axtell, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 443 days.

(21) Appl. No.: 10/688,088

(22) Filed: Oct. 17, 2003

(65) Prior Publication Data

US 2005/0084788 A1 Apr. 21, 2005

(51) Int. Cl.
*G03C 1/72* (2006.01)

(52) U.S. Cl. ..... 430/138; 430/935; 427/374.1; 427/398.1; 427/402; 427/414

(58) Field of Classification Search ..... None
See application file for complete search history.

(56) References Cited

U.S. PATENT DOCUMENTS

| | | | | |
|---|---|---|---|---|
| 3,508,947 | A | 4/1970 | Hughes | |
| 4,399,209 | A | 8/1983 | Sanders et al. | |
| 4,416,966 | A | 11/1983 | Sanders et al. | |
| 4,440,846 | A | 4/1984 | Sanders et al. | |
| 4,766,050 | A | 8/1988 | Jerry | |
| 4,791,004 | A | 12/1988 | Suzuki et al. | |
| 4,921,729 | A | 5/1990 | Kaneko et al. | |
| 5,340,613 | A | 8/1994 | Hanzalik et al. | |
| 5,378,542 | A | 1/1995 | Hanzalik et al. | |
| 5,783,353 | A | 7/1998 | Camillus et al. | |
| 6,030,740 | A | 2/2000 | Polykarpov | |
| 6,365,319 | B1 | 4/2002 | Heath et al. | |
| 6,455,240 | B1 * | 9/2002 | Adams et al. | 430/512 |
| 6,544,711 | B1 | 4/2003 | Anderson et al. | |
| 2002/0045121 | A1 | 4/2002 | Higuchi et al. | |
| 2003/0174264 | A1 | 9/2003 | Stephenson et al. | |

FOREIGN PATENT DOCUMENTS

| | | |
|---|---|---|
| EP | 0 831 361 | 3/1998 |

* cited by examiner

*Primary Examiner*—John A. McPherson
(74) *Attorney, Agent, or Firm*—Sarah Roberts; Donna Suchy

(57) ABSTRACT

This invention relates to a method of coating multiple layers on a support comprising a) taking a support;
b) simultaneously coating on said support a chill settable layer and a non-chill settable layer;
c) lowering the temperature of the layers to immobilize said layers; and
d) drying said layers. It further relates to imaging elements made by this process.

21 Claims, No Drawings

METHOD OF COATING A MULTILAYERED ELEMENT

FIELD OF THE INVENTION

This invention relates to a method of coating layers on a support, particularly to form an imaging element and more particularly to form a light sensitive and heat or pressure developable imaging element comprising) a light sensitive image forming unit comprising heat or pressure sensitive microcapsules, said imaging element further comprising two protective overcoat layers.

BACKGROUND OF THE INVENTION

For a product of multiple-layer structure, it is advantageous to coat multiple layers simultaneously to improve manufacturing productivity. For imaging elements, particularly photographic silver halide imaging elements, the layers are typically coated employing multilayer slide bead coating processes such as described in U.S. Pat. No. 2,716,419 and multilayer slide curtain coating processes such as described in U.S. Pat. No. 3,508,947. The key factors allowing the coating of multiple layers without intermixing are twofold, high viscosity of the coating solution and the ability to immobilize solutions quickly. An aqueous gelatin solution has a unique thermally reversible gelation property, it is liquid above its gelation temperature, and it gels below its gelation temperature (ref. Chapter 2, *The Theory of the Photographic Process*, by T. H. James). This unique property is often referred to as "chill-setting", and is important and useful to provide the crucial first stage of the post-coating process, i.e. locking the layer-structure in place and giving it mechanical stability to perturbation during drying. Gelatin is generally used in every coating layer as the vehicle to allow chill-setting to occur quickly in photographic products. The temperature for chill-setting to occur depends on the type of gelatin, gelatin concentration, pH, ionic strength of coating solution, other components in the solution, time, and various other factors, generally ranging from 30° C. to 0° C.

In recent years various dry-type image-imaging processes which utilize a color-forming component capable of generating visible images by coloration or discoloration reaction have been disclosed in the patent literature. These imaging processes do not use a liquid developing solution or the like and, therefore, do not generate wastes. Both light sensitive and heat developable and light sensitive and pressure developable processes have been discussed in great detail. Both processes utilize a photopolymerization composition to create a latent image by irradiating the imaging element with light through an image original or using a digital image file. The latent image is composed of domains exposed to light at different degrees (from unexposed to fully exposed areas). The fully exposed domains have the highest degree of hardening and the unexposed domains have lowest degree of hardening. Under heat or pressure or both, a visible image is formed due to the difference in the mobility of the color-forming component, said mobility being controlled by the degree of hardening. For example, in the unexposed area the color-forming component can move freely to allow a color formation reaction and in the fully exposed area the color-forming component cannot move, thereby inhibiting a color formation reaction.

Imaging systems employing microencapsulated radiation sensitive compositions have been disclosed in U.S. Pat. Nos. 4,399,209; 4,416,966; 4,440,846; 4,766,050; and 5,783,353.

These imaging systems are characterized in that an imaging sheet including a layer of microcapsules containing a photohardenable composition in the internal phase is image-wise exposed to light. In the most typical embodiments, the photohardenable composition is a photopolymerization composition including a polyethylenically unsaturated compound and a photoinitiator. A color former is encapsulated with the photopolymerization composition. Exposure to light hardens the internal phase of the microcapsules. Following exposure, the imaging sheet is developed by subjecting it to a uniform rupturing force in the presence of a developer.

An image transfer system in which the developer material is coated on a separate substrate as a separate developer or copy sheet is disclosed in U.S. Pat. No. 4,399,209. A self-contained imaging system in which the encapsulated color former and the developer material are present in one layer or in two interactive layers is disclosed in U.S. Pat. No. 4,440,846. Self-contained imaging systems having an opaque support are disclosed in commonly assigned U.S. Pat. No. 6,080,520. A two-sided imaging material is disclosed in commonly assigned U.S. Pat. No. 6,030,740.

The imaging system is capable of providing a full color imaging material in which the microcapsules are in three sets containing cyan, magenta, and yellow color formers respectively sensitive to red, green, and blue light. For good color balance, the light sensitive microcapsules are sensitive (X max) at about 450 nm, 540 nm, and 650 nm, respectively. Such a system is useful with visible light sources in direct transmission of reflection imaging. It is further useful in making contact prints, projected prints of color photographic slides, or in digital printing. It is also useful in electronic imaging using lasers or pencil light sources of appropriate wavelengths. Because digital imaging systems do not require the use of visible light, sensitivity can be extended into the UV and IR to spread the absorption spectra of the photoinitiators and avoid cross talk.

U.S. Pat. No. 5,783,353 discloses a self contained imaging system wherein the imaging layer is sealed between two supports to form an integral unit (laminated structure). The sealed format is advantageous in that it can reduce oxygen permeation and improve stability of the media. U.S. Pat. No. 6,365,319 discloses a self-contained imaging assembly which has an imaging layer containing developer and photohardenable microcapsules placed between two support members, wherein one support is transparent and one support is opaque, and comprises a metallic barrier layer, and exhibits a water vapor transmission rate of less than 0.77 $g/m^2/day$ (0.05 g/100 $in^2/day$). U.S. Pat. No. 6,544,711 B1 discloses a self-contained imaging system which has an imaging layer containing developer and photohardenable microcapsules placed between two support members, wherein at least one support is transparent and at least one support comprises a ceramic barrier layer and exhibits a water vapor transmission rate not more than about 0.47 $g/m^2/day$ (0.03 g/100 $in^2/day$). While the laminated structure has improved media stability and protection against damage, the clear over-laminate through which one views the image degrades image sharpness and resolution. In addition, the laminated structure adds complexity and cost to manufacture.

U.S. Application 2002/0045121 A1 discloses a self-contained photosensitive material which includes an imaging layer of photosensitive microcapsules and a developer on a support and a protective coating oil the imaging layer. The protective coating comprises a water-soluble or water-dispersible resin and provides scratch resistance and water resistance to the imaging media. The protective coating may also include a cross-linking agent, UV absorbing compounds, and pigments. Such elements have a number of disadvantages: The element has inherently low surface gloss. It requires careful handling to avoid accidentally rupturing the photosensitive microcapsules prior to exposure. In addition, such an element is prone to scratches, pressure marks, and cinch marks during manufacturing winding, rewinding, and finishing operations.

It is difficult to coat multiple layers which do not contain gelatin or other chill-settable materials because coating solutions mix and the intended layered structure is not obtained. It is easy, but not desirable, to coat one layer at a time, due to the excessive time and energy required on the coating machine. As new imaging elements which utilize non-gelation layers are developed, it is becoming crucial to develop efficient and effective methods for coating such materials productively in a manufacturing facility.

SUMMARY OF THE INVENTION

This invention provides a method of coating multiple layers on a support comprising a) taking a support;

b) simultaneously coating on said support a first chill settable layer and a non-chill settable layer;

c) lowering the temperature of the layers to immobilize said layers; and d) drying said layers. It more specifically provides a method for coating layers of an imaging element.

This invention further provides an imaging element comprising a support, a non-chill settable layer, and a chill settable layer wherein the non-chill settable layer is between the support and the chill settable layer and wherein the non-chill settable layer preferably has a dry thickness greater than 10 μm.

This invention allows high speed manufacturing of mutilayered elements comprising non-chill settable layers, particularly imaging elements, using existing manufacturing equipment. The resulting element has good coating uniformity. Imaging elements coated by the method of the invention also exhibit excellent image quality.

DETAILED DESCRIPTION OF THE INVENTION

The method of the invention is suitable for coating multilayers onto a substrate. In one embodiment it is utilized for manufacturing imaging elements, although the technique could be utilized in other areas such as coating releasable aqueous coatable adhesive layers at high speed. It may also be useful for coating multilayers containing liquid crystals, particularly chiral nematic or cholesteric liquid crystals. Any method known in the art for simultaneously coating liquid layers onto a support may be utilized in the current invention. The preferred method of applying or coating the layers on the support can be summarized by the definition put forth by Gutoff et al where coating is described as "multiple streams exiting onto an inclined plane without mixing, across a gap and onto a moving web. The streams remain separate and distinct from the moment they emerge onto the slide, cross the gap, get coated onto the web and in the final dried coating". (Gutoff, Edgar B., Cohen Edward D. (1995). *Coating and Drying Defects Troubleshooting Operating Problems*, John Wiley and Sons, p. 101). Simultaneous mulitlayer coating processes are also described in U.S. Pat. No. 2,716,419 (the method employing a multilayer slide bead coating process) and U.S. Pat. No. 3,508,947 (the method of a multilayer slide curtain coating process). Preferably the web (support) is transported to the coating point where the layers are simultaneously applied across the gap. Preferably a multi-slotted slide hopper is used in the method of the invention.

In the method of the invention a first one chill settable layer and a non-chill settable layer are simultaneously coated on the support. The first chill settable layer preferably has a wet laydown thickness greater than 20%, and more preferably greater than 30% of the wet laydown thickness of the non-chill settable layer.

The support may be any suitable substrate for receiving multilayer coatings. Preferably the support is low cost and easy to utilize. Additionally it is desirable, particularly for print imaging elements, that the support has high stiffness, excellent surface uniformity and smoothness, high opacity, humidity curl resistance, and resistance to cockle. Examples of suitable supports include paper or resin-coated paper, plastics such as a polyolefin type resin or a polyester-type resin such as poly(ethylene terephthalate), polycarbonate resins, polysulfone resins, methacrylic resins, cellophane, acetate plastics, cellulose diacetate, cellulose triacetate, vinyl chloride resins, poly(ethylene naphthalate), polyester diacetate, various glass materials, etc., or those comprising a pore structure such as those made from polyolefins or polyesters. The thickness of the support employed in the invention can be, for example, from about 12 to about 500 μm, preferably from about 75 to about 300 μm. Preferably the support is one suitable for use in an imaging element such as paper or resin-coated paper, plastics such as a polyolefin type resin or a polyester-type resin such as poly(ethylene terephthalate), polycarbonate, cellulose diacetate, cellulose triacetate, poly(ethylene naphthalate), polyester diacetate or those comprising a pore structure such as those made from polyolefins or polyesters. A support, particularly for an imaging element, may comprise several layers such as a paper or polymeric core and several resin coated layers. These coatings are considered to be part of the support and are not included in the definition of the layers coated in the above method. The support, with its various layers, is manufactured in a separate process. The support is then transferred to the appropriate coating apparatus for application of the hereafter described layers.

In one preferred embodiment the support is one suitable for a heat or pressure developable imaging element such as described below. A particularly preferred support for a pressure developable element is a support comprising polyolefin or a copolymer thereof, wherein said substrate has a density of greater than 0.9 grams/cc and preferably greater than 1.0 grams/cc. In one embodiment of the pressure developable imaging element the support further comprises at least one unoriented layer, hereinafter called a flange layer, comprising polyolefin or a copolymer thereof. While the purpose of the layer is mainly to stiffen the support it may provide other functions also, such as caliper, optical properties, adhesion, and smoothness. In a preferred embodiment the support comprises two unoriented flange layers, and the polyolefin substrate is sandwiched between the two unoriented flange layers, forming a polyolefin substrate core.

The first chill settable layer is made up of materials such that when the temperature of the coated solution is lowered, the viscosity of the material increases or the material forms a linkage or network of transitional solids such that when the layer undergoes the drying process, the air flow or air temperatures used in drying do not cause any variation in coating thickness or gross imperfection to be seen. The most commonly used chill settable material is gelatin; however, the composition of the chill settable layer may include, but is not exclusive to gelatin. Agar, a polysaccharide from seaweed, is another example of a chill settable material. The temperature at which chill setting occurs depends on the type of gelatin, the gelatin concentration, pH, ionic strength of the coating solution and other components in the solution. It also depends on various other factors such as, time. The typical temperature is below 30° C. and above 0° C. In one embodiment the first chill settable layer includes the same binder components (hydrophilic colloids and water dispersible resins) as the protective layers of the light sensitive and heat and pressure developable imaging elements described hereafter. The first chill settable layer may comprise sub-layers of varying compositions as long as all of the sub-layer are chill settable and are applied simultaneously.

The non-chill settable layer is a layer wherein the composition is such that by solely lowering the temperature of the layer, without the presence of any other components or layer parts, the viscosity of the layer is not increased significantly enough to allow this layer to pass through the drying process without causing variation in the coating thickness or gross imperfections. Such a layer will not be immobilized until it actually freezes or dries. However, freezing a coating layer not only requires more energy, but also generates a different type of imperfection from the formation of crystal structure of water. Examples of non-chill settable materials include aqueous dispersible polymers such as latex, polyurethane or polyester, inorganic oxide dispersions, aqueous solutions containing polymers such as cellulose derivatives (e.g., cellulose esters), polysaccharides, casein, and the like, and synthetic water permeable colloids include poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid. Solutions that do not contain chill settable materials, such as gelatin, Agar, etc., usually are non-chill settable. In one embodiment the non-chill settable layer may include the same binder components as the image forming unit of the light sensitive and heat and pressure developable imaging elements described hereafter. The non-chill settable layer may comprise sub-layers of varying compositions as long as all of the sub-layer are non-chill settable and are applied simultaneously.

Preferably the non-chill settable layer is porous after it is dried. The pores may be formed by drying at a temperature that is lower than the coalescing (film-forming) temperature of the materials in the non-chill settable layer. It may also contain materials which can modify the porosity of the layer.

In a preferred embodiment the non-chill settable layer is closest to the support, i.e., between the support and the first chill settable layer. This may also be described as the first chill-settable layer being above or on top of the non-chill settable layer. In one embodiment the non-chill settable layer corresponds to the image forming unit of the light sensitive and heat and pressure developable imaging elements described hereafter and the first chill settable layer corresponds to the protective layers described for said elements. The sub-layers (if present) of the non-chill settable layer correspond to the differing layers of the image forming unit. The first chill settable layer may have an outer sub-layer and an inner sub-layer which correspond to the inner and outer protective layers described below. Preferably the outer chill settable sub-layer has a Young's modulus greater than the Young's modulus of the inner chill settable sub-layer once water is removed and layers are dried. In one embodiment the inner chill settable sub-layer has a Young's modulus of less than 3 Gpa and the outer chill settable sub-layer has a Young's modulus of greater than 3 Gpa. The first chill settable and non-chill settable layers may contain any of the components contained in the protective layers and the image forming units as described.

Once the first chill settable and non-chill settable layers are applied, they undergo a chilling process wherein the temperature of the coating is lowered below the coating temperature. In this process the coating is passed through conditions that can be as high as 30° C., and as low as 0° C. Preferably the temperature is less than 20° C. and more preferably less than 10° C. After the coating is applied and goes through the chill setting process, it is then dried in a manner that will not disturb the layer thickness or uniformity as the solvent is removed, such as by forced air drying. The temperature at which the coating is dried should not exceed 50° C.

In one embodiment the method is used to produce an imaging element comprising a support, a non-chill settable layer and a first chill settable layer wherein the non-chill settable layer is between the support and the chill settable layer and wherein the non-chill settable layer has a dry thickness of at least 10 μm. In one embodiment the imaging element is a light sensitive and heat or pressure developable imaging element as described below. When the non-chill settable layer is an image forming unit of a light sensitive and heat or pressure developable element the thickness of the image forming unit is preferably in the range of 0.1 to 50 μm, more preferably in the range of 5 to 35 μm, and most preferably in the range of 10 to 30 μm.

In another embodiment, not limited to an imaging element, wherein the non-chill settable layer is coated between the support and the first chill settable layer, an additional (second) chill settable layer is coated below the non-chill settable layer, i.e., the non-chill settable layer is sandwiched between two chill settable layers. Preferably all three layers are coated simultaneously. This second chill settable layer, for example, could be used as a chemical barrier layer. The second chill settable layer meets the same definition for chill setting at the first chill settable layer. It preferably comprises gelatin. In one suitable embodiment the second chill settable layer is utilized in an imaging element, preferably a light sensitive and heat or pressure developable element.

In the coating application process it is desirable to provide a method to allow the movement of water between the non-chill setting layers and the setting layers, as well as the substrate. This diffusion of water assists in the immobilization process. In one preferred embodiment either the support absorbs water or an additional layer which absorbs water may be coated on the support. The water absorbing layer, if present, is between the support and the non-chill settable layer, and generally is directly adjacent to the support. The water absorbing layer may be chill settable. Preferably this layer is a gelatin layer. In one embodiment this layer corresponds to the non-imaging layer described below for the light sensitive and heat or pressure developable imaging element. The water absorbing layer is generally applied separately and then dried prior to coating the chill settable and non-chill settable layers. It is possible to coat the water absorbing layer simultaneously with the chill settable and non-chill settable layers. If a second chill settable layer is utilized the water absorbing layer is generally between the support and the second chill settable layer.

The imaging element of the present invention can be prepared by a process comprising the steps of preparing a coating liquid for forming a light sensitive and heat developable or light sensitive and pressure developable image forming unit or the separate imaging layers and a coating liquid for forming protective layers or intermediate layer by, for example, dissolving or dispersing the respective constituent components in solvents. The coating liquids are applied simultaneously onto a desired support, preferably by multi-slot hopper, and are then dried. Examples of the solvent that can be used for the preparation of the coating liquids include water; alcohols such as methanol, ethanol, n-propanol, isopropanol, n-butanol, sec-butanol, methyl cellosolve, and 1-methoxy-2-propanol; halogen-based solvents such as methylene chloride and ethylene chloride; ketones such as acetone, cyclohexanone, and methyl ethyl ketone; esters such as methyl cellosolve acetate, ethyl acetate, and methyl acetate; toluene; xylene; and a mixture of two or more thereof. Among these solvents, water is particularly preferable.

It is preferred that at the temperature of the coating process, the viscosity of the coating solution for the protective layer(s) (first chill settable layer) is higher than that of the non-chill settable layer, preferably at least 2 times higher. The viscosity of the coating solution for the outer chill settable layer is preferred to be higher than that of the inner chill settable layer. The outermost layer is preferred to have the highest viscosity among all of the coating solutions.

Used herein, the phrase 'imaging element' comprises the light sensitive and heat and pressure developable imaging element as described below. The phrase also comprises an image receiving layer as applicable to multiple techniques governing the transfer of an image onto the imaging element. Such techniques include thermal dye transfer, electrophotographic printing, such as xerographic and thermographic, or ink jet printing, as well as a support for photographic silver halide images. As used herein, the phrase "imaging element" also comprises a material that utilizes photosensitive silver halide in the formation of images. The pharse imaging element also includes elements comprising liquid crystals, particularly chiral nematic or cholesteric liquid crystals. Preferably the liquid crystals can be written to varying states of reflectivity using an electric field and can remain in the written state in the absence of the electric field used to write the image, such as described in U.S. Patent Application 2003/0174264 A1, incorporated herein by reference.

Preferably the method of the invention is used to prepare an imaging element comprising a support, a light sensitive imaging forming unit comprising microcapsules and a developer, an inner protective layer overlaying the image forming unit, i.e., on the opposite side of the image forming unit from the support. It further comprises an outer protective layer overlaying the inner protective layer. The outer protective overcoat layer preferably has a modulus greater than the modulus of the inner protective layer. The outermost protective layer protects the imaging element against scratches, pressure marks, cinch marks, and water resistance. The inner protective overcoat layer protects the imaging elements from damage by ultraviolet rays. The inner protective layer also act as a cushioning layer to protect the image element from damage by handling. The two-layer format also provides significant gloss improvement over a single protective layer.

It is preferred that the outer protective overcoat layer has a modulus greater than the modulus of the inner protective layer. i.e. that the inner layer be softer than the outer layer. Preferably the inner protective overcoat layer has a Young's modulus less than 3 Gpa, and the outer protective layer has a Young's modulus greater than 3 Gpa. The Young's modulus ratio of the outer protective layer to inner protective layer is preferably greater than 1.2, and more preferably greater than 1.5. The thickness of the outer protective layer ranges from 0.1 to 6 μm, and preferably from 0.3 to 4 μm, and more preferably from 0.5 to 3 μm. The thickness of the inner protective layer is greater than 0.5 μm, and preferably greater than 1 μm, and more preferably from 2 to 15 μm. The ratio of inner protective layer thickness to the outer protective layer thickness is greater than 1.

The inner protective overcoat layer is chill settable and preferably comprises a hydrophilic colloid. The hydrophilic colloid useful for the present invention includes both synthetic and natural water soluble polymers. Preferably the hydrophilic polymers suitable for use in the present invention further comprise either a chemical moiety capable of forming a covalent chemical bond with a cross-linker. Naturally occurring substances include proteins, protein derivatives, cellulose derivatives (e.g., cellulose esters), polysaccharides, casein, and the like, and synthetic water permeable colloids include poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like, and the mixture thereof, providing that the mixture solution is chill settable. Gelatin is the most preferred hydrophilic colloid for the present invention.

The inner protective overcoat layer may further comprise a water dispersible resin. Resins which can be used in the protective coating of the present invention include those having film-forming properties. When formed into a film by drying or curing, the resin should be essentially transparent and remain transparent over a broad temperature range without clouding or yellowing. The resin film should also impart scratch resistance, water resistance, gloss, and durability to the protective coating. Examples of water-dispersible resins include acrylic latex (e.g., acrylic ester, modified acrylic ester, acrylic ester copolymer, modified acrylic ester copolymer) and other polymer latices (e.g., styrene-butadiene copolymer, styrene-maleic anhydride copolymer, butadiene-methacrylate copolymer, vinylacetate-vinyl chloride-ethylene copolymer, vinylidene chloride-acrylonitrile copolymer, etc.). In one embodiment, the resin used in the protective coating is an acrylic latex. Examples of acrylic latices include, but are not limited to, acrylic esters, modified acrylic esters, acrylic ester co-polymers, and modified acrylic ester copolymers. In another embodiment of the invention, the resin used in the protective overcoat is a water dispersible polyurethane, or an acrylic-polyurethane hybrid.

The outer protective overcoat layer is also chill settable and may comprise the same hydrophilic colloids and water dispersible resins as described above for the inner protective layer. Different amount and type of water dispersible resin determines the modulus of the layer. Cross-linking agents may be incorporated into the inner and outer protective coating composition, depending on the types of polymer used, to ensure that the protective coating provides the desired properties, namely water resistance, scratch resistance, and gloss. Examples of preferred cross-linking agents used in the protective coating include, but are not limited to, polyvalent aldehyde compounds such as glyoxal, glutaraldehyde, and derivatives of those compounds which retain free aldehyde groups. Glyoxal is the preferred polyaldehyde. Other cross-linking agents useful in the present invention include di-isocyanate compounds, epoxy compounds, bis-ethyleneimine compounds, di-vinyl compounds (e.g., divinylbenzene), methacrylic (or acrylic) ester of polyhydric alcohol (e.g., TMPTA), allylglycidyl ether, di-epoxide of polyhydric alcohol, methacrylic anhydride, N-methylolacrylamide, organic peroxide, di-amine compounds, bis-2-oxazoline compounds, polymers having 2-oxazoline group and polymer having carbodiimide group. The cross-linking agent is typically present in an amount from about 2% to 20%, and preferably from about 4% to 10%, based on total solids content of the protective coating.

The inner protective layer and the outer protective layer may further include other additional components such as surfactants, UV absorbing compounds, light stabilizers, pigments, matting agents, fillers, etc. Inclusion of surfactants as wetting agents allows the aqueous coating solution to spread uniformly across the photosensitive layer's surface and produce a smooth coating. Generally, the amount of wetting agent in the coating solution should be from about 1% to about 10% by weight of the coating solution, more preferably from about 4% to about 8%. Examples of wetting agents include dialkyl sulfosuccinate sodium salt and anion fluoroalkyl type surfactants. These surfactants are commercially available from Kao Corp. (PELEX OTP) and Dainippon Ink Chemicals, Inc. (Megafac F140NK), respectively.

Preferably the ultraviolet (UV) ray absorbing compounds are in the inner protective layer. Such compounds improve the light resistance and stability of the image media. The types of UV ray absorbers which can be used for the practice of the present invention are not particularly limited, provided their absorption maximum wavelengths fall within the range of 300 to 400 nm and they have no harmful effect on the imaging properties of the element. Such UV dyes include ultraviolet absorbers of the thiazolidone type, the benzotriazole type, the cinnamic acid ester type, the benzophenone type, and the aminobutadiene type and have been described in detail in, for example, U.S. Pat. Nos. 1,023,859; 2,685,512; 2,739,888; 2,748,021; 3,004,896; 3,052,636; 3,215,530; 3,253,921; 3,533,794; 3,692,525; 3,705,805; 3,707,375; 3,738,837; and 3,754,919; and British Patent 1,321,355. Preferably the UV absorber is a benzotriazole compound and, in particular, a high molecular weight benzotriazole emulsion. A specific material this type is ULS-1383 MG available from Ipposha Oil. The amount of the ultraviolet absorbing compound is not limited specifically; it is desirable to adjust the amount preferably to 5% to 30% based on total solids content of the protective coating.

The outer protective layer may further comprise a hard filler that has a modulus greater than 10 Gpa. Representative hard fillers include colloidal silica, colloidal tin oxide, colloidal titanium dioxide, mica, clays, doped-metal oxides, metal oxides containing oxygen deficiencies, metal antimonates, conductive nitrides, carbides, or borides, for example, $TiO_2$, $SnO_2$, $Al_2O_2$, $ZrO_3$, $In_2O_2$, MgO, $ZnSb_2O_2$, $InSbO_2$, $TiB_2$, $ZrB_2$, $NbB_2$, $TaB_2$, $TaB_2$, $CrB_2$, MoB, WB, $LaB_6$, ZrN, TiN, TiC, and WC. Preferably, the hard filler has a refractive index less than or equal to 2.1, and most preferably less than or equal to 1.6. Preferably the outer protective layer comprises greater than 10%, more preferably than 15% hard filler. It is important to limit the refractive index of the filler in order to provide good transparency of the layer. The filler also has a particle size less than or equal to 500 nm, and preferably, less than 100 nm.

The outer protective layer may further comprise a pigment to improve handling and to prevent blocking, i.e. to prevent the front side of the media from sticking to any surface. The pigment is defined to have a particle size of greater than 0.5 μm. Examples of the pigment may include inorganic pigments such as calcium carbonate, zinc oxide, titanium dioxide, silicone dioxide, aluminum hydroxide, barium sulfate, zinc sulfate, talc, kaolin, clay and colloidal silica, and organic pigments such as polystyrene or poly (methyl methacrylate) particles, nylon powder, polyethylene powder, urea-formaldehyde resin filler, and raw starch particles.

The outer protective layer may further comprise a lubricant. Examples of lubricants include (1) silicone based materials disclosed, for example, in U.S. Pat. Nos. 3,489,567; 3,080,317; 3,042,522; 4,004,927; and 4,047,958; and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964; in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, and the like; (4) perfluoro- or fluoro- or fluorochloro-containing materials, which include poly(tetrafluoroethlyene), poly(trifluorochloroethylene), poly(vinylidene fluoride, poly(trifluorochloroethylene-co-vinyl chloride), poly(meth)acrylates or poly (meth)acrylamides containing perfluoroalkyl side groups, and the like. Lubricants useful in the present invention are described in further detail in *Research Disclosure* No.308, published Decemberr 1989, page 1006.

The imaging element of the invention may further comprise at least one non-imaging layer comprising a hydrophilic colloid located between the support and the imaging unit. Examples of suitable hydrophilic colloids include both synthetic and natural water soluble polymers. Preferably the hydrophilic polymers suitable for use in the present invention further comprise either a chemical moiety capable of capable of forming a covalent chemical bond with a crosslinker. Naturally occurring substances include proteins, protein derivatives, cellulose derivatives (e.g., cellulose esters), polysaccharides, casein, and the like, and synthetic water permeable colloids include poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic colloid for the present invention.

The non-imaging layer may further comprise a latex or a water dispersible resin. Resins which can be used in the non-imaging layer of the present invention include those having film-forming properties. When formed into a film by drying or curing, the resin should be essentially transparent and remain transparent over a broad temperature range without clouding or yellowing. Examples of water-dispersible resins include acrylic latex (e.g., acrylic ester, modified acrylic ester, acrylic ester copolymer, modified acrylic ester copolymer) and other polymer latices (e.g., styrene-butadiene copolymer, styrene-maleic anhydride copolymer, butadiene-methacrylate copolymer, vinylacetate-vinyl chloride-ethylene copolymer, vinylidene chloride-acrylonitrile copolymer, etc.). In one embodiment, the filler used in the non-imaging layer is an acrylic latex. Examples of acrylic latices include, but are not limited to, acrylic esters, modified acrylic esters, acrylic ester co-polymers, and modified acrylic ester copolymers. In another embodiment of the invention, the filler used in the non-imaging layer is a water dispersible polyurethane or an acrylic-polyurethane hybrid. In one embodiment the non-imaging layer may comprise a cross-linker as described above for the protective layers.

If necessary, an antihalation layer may be provided on the surface of the support to be used. The imaging element may also comprise an antistatic layer, preferably on the back of the support, i.e., the opposite side of the support from the imaging unit. Further, a sliding layer, a curl-preventive layer, an adhesive layer, or the like may be provided on the back of the support to be used. Further, if necessary, an adhesive layer may be provided between a support and the light sensitive and heat developable or the light sensitive and pressure developable image forming unit such that the support is used as a peel paper to thereby provide an aspect having a seal.

When an antihalation layer is provided between a support and the light sensitive and heat developable or the light sensitive and pressure-developable image forming unit or alternatively, on the support surface facing the side having image forming unit in the case of a transparent support, the antihalation layer may be one that can be bleached by irradiation with light or by the application of heat.

For the preparation of a layer that can be bleached by irradiation with light, for example, a combination of the organic dye and organic borate compound described previously can be used. For the preparation of a layer that can be bleached by heat, for example, a composition in which the heat generates a base or nucleophile capable of bleaching the organic dye that is present can be utilized.

The imaging element of the present invention comprises a support and an image forming unit above the support. It may be a light sensitive and heat developable type imaging element comprising a support having at least one light sensitive and heat developable image forming unit provided thereon; or a light sensitive and pressure developable type imaging element comprising a support having at least one light sensitive and pressure developable image forming unit provided thereon. Examples of these imaging elements include the following imaging element types (a), (b) and (c).

Element type (a) is a light sensitive and heat-developable imaging element comprising a support having a light sensitive and heat developable image forming unit provided thereon which contains heat-responsive microcapsules enclosing a color-forming component A. Outside the microcapsules is a photopolymerization composition comprising at least a substantially colorless compound B (polymerizable developer) having in the molecule thereof a polymerizable group and a site which reacts with the color-forming component A to develop a color, and a photopolymerization initiator. In the light sensitive and heat developable imaging element (a), exposure to light according to a desired image causes the photopolymerization composition (compound B) present outside the microcapsules to harden by a polymerization reaction due to the radical generated from the photopolymerization initiator so that a latent image in a desired shape is formed. Next, when the imaging element is heated, the compound B present in unexposed portions which has not polymerized moves within the imaging element and reacts with the color-forming component A inside the microcapsules to develop a color. Accordingly, the light sensitive and heat developable image-imaging element (a) is a positive-type, light sensitive and heat developable imaging element in which the image formation is performed such that color formation does not take place in exposed portions but take place in the unexposed portions that do not harden.

Element type (b) is a light sensitive and heat-developable imaging element comprising a support having a light sensitive and heat developable image forming unit provided thereon which includes heat-responsive microcapsules enclosing a color-forming component A. Outside the microcapsules is a photopolymerization composition comprising at least a substantially colorless compound C (developer) which reacts with the color-forming component A to develop a color, a substantially colorless compound D (polymerizable compound) having in the molecule thereof a polymerizable group, and a photopolymerization initiator. In the light sensitive and heat developable imaging element (b) exposure to light according to a desired image causes the compound D having a polymerizable group to harden by a polymerization reaction due to the radical generated from the photopolymerization initiator so that a latent image is formed in a desired shape. Next, depending on the film property of the latent image (i.e., hardened portion), when the element is heated the compound C moves and reacts with the color-forming component A inside the microcapsules to form an image.

Element type (c) is a light sensitive and pressure-developable imaging element comprising a support having a light sensitive and pressure developable image forming unit provided thereon which includes light and pressure-response microcapsules enclosing a color-forming component A, a polymerizable compound, and a photopolymerization initiator. Outside the microcapsules is a substantially colorless compound E (developer) designed to react with the color-forming component A to develop a color. In the light sensitive and pressure developable imaging element (c), exposure to light according to a desired image causes the polymerizable compound present inside the microcapsules to harden the microcapsule interior by a polymerization reaction due to the radical generated from the photopolymerization initiator upon exposure so that a latent image in a desired shape is formed. That is, in the exposed portions, the color-forming reaction with the compound E present outside the microcapsules is inhibited. Next, when pressure is applied to the imaging element, the microcapsules which have not hardened (the unexposed microcapsules) are broken and the compound E present in the unexposed portions moves within the imaging element and reacts with the color forming component A present inside the microcapsules to develop a color. Accordingly, the light sensitive and pressure developable image-imaging element (c) is a positive-type, light sensitive and pressure developable imaging element in which the image formation is performed such that color formation is not made in exposed portions but color formation is made in the unexposed portions that do not harden.

The imaging element described above comprises a support having a light sensitive and heat developable image forming unit or a light sensitive and pressure developable image forming unit provided thereon. In a preferred embodiment the element comprises an image forming unit which is light sensitive and pressure developable, i.e., it is exposed by light and developed by applying pressure and selectively rupturing the microcapsules. The image forming unit of the various element types may comprise one layer or more than one layer. The microcapsules and the developer may be in the same layer or in different layers. Preferably they are in the same layer. Microcapsules which are sensitive to different wavelengths of the spectrum may be in the same layer or in different layers. Preferably they are in the same layer.

The color-forming component A useful for the practice of the invention include an electron-donating, colorless dye such that the dye reacts with a developer (i.e., compound B, compound C, or compound E) to develop a color. Specific examples of these color-forming components include those described in Chemistry and Applications of Leuco Dye, Edited by Ramaiah Muthyala, Plenum Publishing Corporation, 1997. Representative examples of such color formers include substantially colorless compounds having in their partial skeleton a lactone, a lactam, a sultone, a spiropyran, an ester or an amido structure. More specifically, examples include triarylmethane compounds, bisphenylmethane compounds, xanthene compounds, thiazine compounds and spiropyran compounds. Typical examples of the color formers include Crystal Violet lactone, benzoyl leuco methylene blue, Malachite Green Lactone, p-nitrobenzoyl leuco methylene blue, 3-dialkylamino-7-dialkylamino-fluoran, 3-methyl-2,2'-spirobi(benzo-f-chrome), 3,3-bis(p-dimethylaminophenyl)phthalide, 3-(p-dimethylaminophenyl)-3-(1,2 dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis-(1,2-dimethylindole-3-yl)6-dimethylaminophthalide, 3,3-bis-(9-ethylcarbazole-3-yl)-5-dimethylaminophthalide, 3,3-bix(2-phenylindole-3-yl)-5-dimethylaminophthalide, 3-p-dimethylaminophenyl-3-(1-methyl pyrrole-2-yl)-6-dimethylaminophthalide, 4,4'-bis-dimethylaminobenzhydrin benzyl ether, N-halophenyl leuco Auramine, N-2,4,5-trichlorophenyl leuco Auramine, Rhodamine-B-anilinolactam, Thodamine-(p-nitroanilino) lactam, Rhodamine-B-(p-chloroanilino)lactam, 3-dimethylamino-6-methoxyfluoran, 3-diethylamino-7-methoxyfluoran, 3-diethylamino-7-chloro-6-methylfluoroan, 3-diethylamino-6-methyl-7-anilinofluoran, 3-diethylamino-7-(acetylmethylamino)fluoran, 3-diethylamino-7-(dibenzylamino)fluoran, 3-diethylamino-7-(methylbenzylamino) fluoran, 3-diethylamino-7-(chloroethylmethylamino) fluoran, 3-diethyl amino-7-(diethylamino)fluoran, 3-methyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran, 3-propyl-spirodibenzoidipyran, etc. Mixtures of these color precursors can be used if desired. Also useful in the present invention are the fluoran color formers disclosed in U.S. Pat. No. 3,920,510, which is incorporated by reference. In addition to the foregoing dye precursors, fluoran compounds such as disclosed in U.S. Pat. No. 3,920,510 can be used. In addition, organic compounds capable of reacting with heavy metal salts to give colored metal complexes, chelates or salts can be adapted for use in the present invention.

The substantially colorless compound B (polymerizable developer) has in the molecule a polymerizable group and a site that reacts with the color-forming component A to develop a color. The substantially colorless compound B may be any compound, such as electron-accepting compound having a polymerizable group, or a coupler compound having a polymerizable group, which has the two functions, i.e., developing a color by reacting with the color-forming component A and hardening by photopolymerization.

The substantially colorless compound C (developer), which has no polymerizable group and reacts with the color-forming component A to develop a color, can also be used. Since compound C has no polymerizable group and it is necessary to impart a function of hardening the film by photopolymerization to the image forming layer, it needs to be used together with the photopolymerizaton composition comprising a compound D having a polymerizable group. The compound C can be any electron-accepting compound having no polymerizable group and that develops a color by reacting with the color-forming components A. Examples of compound C are clay minerals such as acid clay, active clay, attapulgite, etc.; organic acids such as tannic acid, gallic acid, propyl gallate, etc.; acid polymers such as phenol-formaldehyde resins, phenol acetylene condensation resins, condensates between an organic carboxylic acid having at least one hydroxy group and formaldehyde, etc.; metal salts of aromatic carboxylic acids or derivatives thereof such as zinc salicylate, tin salicylate, zinc 2-hydroxy napththoate, zinc 3,5 di-tert butyl salicylate, zinc 3,5-di-(a-methylbenzyl) salicylate, oil soluble metals salts or phenol-formaldehyde novolak resins (e.g., see U.S. Pat. Nos. 3,672,935 and 3,732,120) such as zinc modified oil soluble phenol-formaldehyde resin as disclosed in U.S. Pat. No. 3,732,120, zinc carbonate etc. and mixtures thereof.

Compound D, having at least one polymerizable group, is an addition polymerizable compound selected from among the compounds having at least one, preferably two or more, ethylenically unsaturated bond at terminals. Such compounds are well known in the industry and they can be used in the present invention with no particular limitation. Such compounds have, for example, the chemical form of a monomer, a prepolymer, i.e., a dimer, a trimer, and an oligomer or a mixture and a copolymer of them. As examples of monomers and copolymers thereof, unsaturated carboxylic acids (e.g., acrylic acid, methacrylic acid, itaconic acid; crotonic acid, isocrotonic acid, maleic acid, etc.), and esters and amides thereof can be exemplified, and preferably esters of unsaturated carboxylic acids and aliphatic polyhydric alcohol compounds, and amides of unsaturated carboxylic acids and aliphatic polyhydric amine compounds are used. In addition, the addition reaction products of unsaturated carboxylic esters and amides having a nucleophilic substituent such as a hydroxyl group, an amino group and a mercapto group with monofunctional or polyfunctional isocyanates and epoxies, and the dehydration condensation reaction products of these compounds with monofunctional or polyfunctional carboxylic acids are also preferably used. The addition reaction products of unsaturated carboxylic esters and amides having electrophilic substituents such as an isocyanato group and an epoxy group with monofunctional or polyfunctional alcohols, amines and thiols, and the substitution reaction products of unsaturated carboxylic esters and amides having releasable substituents such as a halogen group and a tosyloxy group with monofunctional or polyfunctional alcohols, amines and thiols are also preferably used. As another example, it is also possible to use compounds replaced with unsaturated phosphonic acid, styrene, vinyl ether, etc., in place of the above-unsaturated carboxylic acids.

Specific examples of ester monomers of aliphatic polyhydric alcohol compounds and unsaturated carboxylic acids include, as acrylates, ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, polyester acrylate oligomer, etc. As methacrylates, examples include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, and bis[p-(3-methacryloxy-2-hydroxypropoxy)phenyl] dimethylmethane, bis[p-(methacryloxyethoxy)-phenyl] dimethylmethane. As itaconates, examples include ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate. As crotonates, examples include ethylene glycol dicrotonate, tetramethylene glycol dicrotonate, pentaerythritol dicrotonate, and sorbitol tetradicrotonate. As isocrotonates, examples include ethylene glycol diisocrotonate, pentaerythritol diisocrotonate, and sorbitol tetraisocrotonate. As maleates, examples include ethylene glycol dimaleate, triethylene glycol dimaleate, pentaerythritol dimaleate, and sorbitol tetramaleate. Further, the mixtures of the above-described ester monomers can also be used. Further, specific examples of amide monomers of aliphatic polyhydric amine compounds and unsaturated carboxylic acids include methylenebis-acrylamide, methylenebis-methacrylamide, 1,6-hexamethylenebis-acrylamide, 1,6-hexamethylenebis-methacrylamide, diethylenetriaminetris-acrylamide, xylylenebis-acrylamide, and xylylenebis-methacrylamide.

Further, urethane-based addition polymerizable compounds which are obtained by the addition reaction of an isocyanate and a hydroxyl group are also preferably used in the present invention. A specific example is a vinyl urethane compound having two or more polymerizable vinyl groups in one molecule, which is obtained by the addition of a vinyl monomer having a hydroxyl group represented by the following formula (V) to a polyisocyanate compound having two or more isocyanate groups in one molecule.

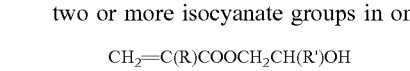

$$CH_2{=}C(R)COOCH_2CH(R')OH$$

wherein R and R' each represents H or $CH_3$.

Other examples include polyfunctional acrylates and methacrylates, such as polyester acrylates, and epoxy acrylates obtained by reacting epoxy resins with (meth)acrylic acids. Moreover, photo-curable monomers and oligomers listed in Sartomer Product Catalog by Sartomer Company, Inc. (1999) can be used as well.

The details in usage of the addition polymerizable compound, e.g., what structure is to be used, whether the compound is to be used alone or in combination, or what an amount is to be used, can be optionally set up according to the final design of the characteristics of the photosensitive material. For example, the conditions are selected from the following viewpoint. For the photosensitive speed, a structure containing many unsaturated groups per molecule is preferred and in many cases bifunctional or more functional groups are preferred. For increasing the strength of an image part, i.e., a cured film, trifunctional or more functional groups are preferred. It is effective to use different functional numbers and different polymerizable groups (e.g., acrylate, methacrylate, styrene compounds, vinyl ether compounds) in combination to control both photosensitivity and strength. Compounds having a large molecular weight or compounds having high hydrophobicity are excellent in photosensitive speed and film strength, but may not be preferred from the point of development speed and precipitation in a developing solution. The selection and usage of the addition polymerizable compound are important factors for compatibility with other components (e.g., a binder polymer, an initiator, a colorant, etc.) in the photopolymerization composition and for dispersibility. For example, sometimes compatibility can be improved by using a low purity compound or two or more compounds in combination. Further, it is also possible to select a compound having specific structure for the purpose of improving the adhesion property of a support and an overcoat layer. Concerning the compounding ratio of the addition polymerizable compound in a photopolymerization composition, the higher the amount, the higher the sensitivity. But, too large an amount sometimes results in disadvantageous phase separation, problems in the manufacturing process due to the stickiness of the photopolymerization composition (e.g., manufacturing failure resulting from the transfer and adhesion of the photosensitive material components), and precipitation from a developing solution. The addition polymerizable compound may be used alone or in combination of two or more. In addition, appropriate structure, compounding ratio and addition amount of the addition polymerizable compound can be arbitrarily selected taking into consideration the degree of polymerization hindrance due to oxygen, resolving power, fogging characteristic, refractive index variation and surface adhesion. Further, the layer constitution and the coating method of undercoating and overcoating can be performed according to circumstances.

Various photoinitiators can be selected for use in the above-described imaging systems. However by far the most useful photoinitators consist of an organic dye and an organic borate salt such as disclosed in U.S. Pat. Nos. 5,112,752; 5,100,755; 5,057,393; 4,865,942; 4,842,980; 4,800,149; 4,772,530 and 4,772,541. The photoinitiator is preferably used in combination with a disulfide coinitiator as described in U.S. Pat. No. 5,230,982 and an autoxidizer which is capable of consuming oxygen in a free radical chain process.

The amount of organic dye to be used is preferably in the range of from 0.1 to 5% by weight based on the total weight of the photopolymerization composition, preferably from 0.2 to 3% by weight. The amount of borate compound contained in the photopolymerization composition of the invention is preferably from 0.1% to 20% by weight based on the total amount of photopolymerization composition, more preferably from 0.3 to 5% by weight, and most preferably from 0.3% to 2% by weight.

The ratio between the organic dye and organoborate salt is important from the standpoint of obtaining high sensitivity and sufficient decolorization by the irradiation of light in the fixing step of the recording process described later. The weight ratio of the organic dye to the organoborate salt is preferably in the range of from 2/1 to 1/50, more preferably less than 1/1 to 1/20, most preferably from 1/1 to 1/10.

The organic dyes for use in the present invention may be suitably selected from conventionally known compounds having a maximum absorption wavelength falling within a range of 300 to 1000 nm. High sensitivity can be achieved by selecting a desired dye having the wavelength range within described above and adjusting the sensitive wavelength to match the light source to be used. Also, it is possible to suitably select a light source such as blue, green, or red, or infrared LED (light emitting diode), solid state laser, OLED (organic light emitting diode) or laser, or the like for use in image-wise exposure to light.

Specific examples of the organic dyes include 3-ketocoumarin compounds, thiopyrylium salts, naphthothiazole-merocyanine compounds, merocyanine compounds, and merocyanine dyes containing thiobarbituric acid, hemioxanole dyes, and cyanine, hemicyanine, and merocyanine dyes having indolenine nuclei. Other examples of the organic dyes include the dyes described in Chemistry of Functional Dyes (1981, CMC Publishing Co., Ltd., pp. 393–416) and Coloring Materials (60[4], pp. 212–224, 1987). Specific examples of these organic dyes include cationic methine dyes, cationic carbonium dyes, cationic quinoimine dyes, cationic indoline dyes, and cationic styryl dyes. Examples of the above-mentioned dyes include keto dyes such as coumarin dyes (including ketocoumarin and sulfonocoumarin), merostyryl dyes, oxonol dyes, and hemioxonol dyes; nonketo dyes such as nonketopolymethine dyes, triarylmethane dyes, xanthene dyes, anthracene dyes, rhodamine dyes, acridine dyes, aniline dyes, and azo dyes; nonketopolymethine dyes such as azomethine dyes, cyanine dyes, carbocyanine dyes, dicarbocyanine dyes, tricarbocyanine dyes, hemicyanine dyes, and styryl dyes; quinoneimine dyes such as azine dyes, oxazine dyes, thiazine dyes, quinoline dyes, and thiazole dyes.

Preferably the organic dye useful for the invention is a cationic dye-borate anion complex formed from a cationic dye and an anionic organic borate. The cationic dye absorbs light having a maximum absorption wavelength falling within a range from 300 to 1000 nm and the anionic borate has four R groups, of which three R groups each represents an aryl group which may have a substitute, and one R group is an alkyl group, or a substituted alkyl group. Such cationic dye-borate anion complexes have been disclosed in U.S. Pat. Nos. 5,112,752; 5,100,755; 5,075,393; 4,865,942; 4,842,980; 4,800,149; 4,772,530; and 4,772,541 which are incorporated herein by reference.

When the cationic dye-borate anion complex is used as the organic dye in the photopolymerization compositions of the invention, it does not require to use the organoborate salt. However, to increase the photopolymerization sensitivity and to reduce the cationic dye stain, it is preferred to use an organoborate salt in combination with the cationic dye-borate complex. The organic dye can be used singly or in combination.

Specific examples of the above-mentioned water insoluble phenols are given below. However, it should be noted that the present invention is not limited to these examples.

Dye-1

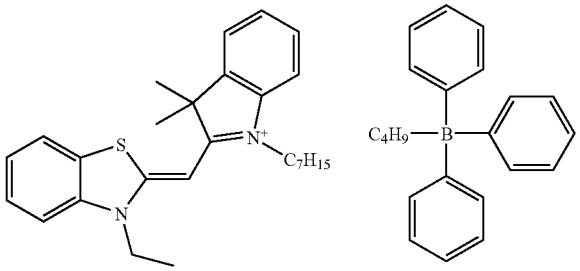

Dye-2

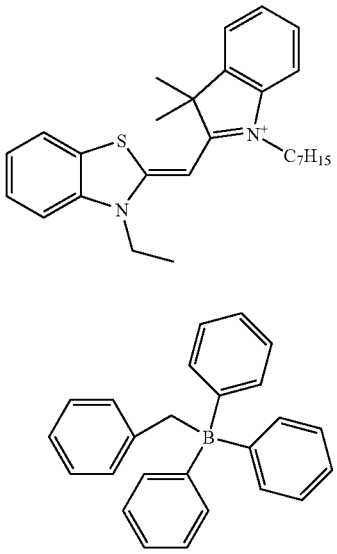

Dye-3

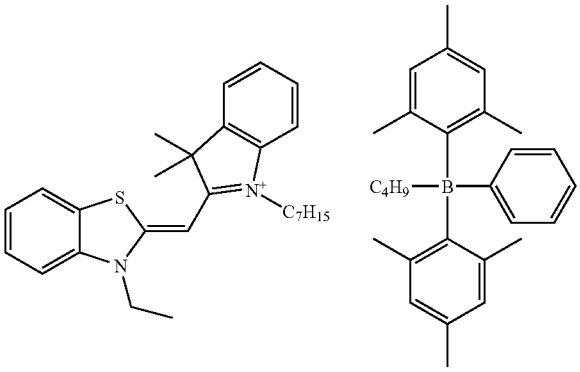

Dye-4

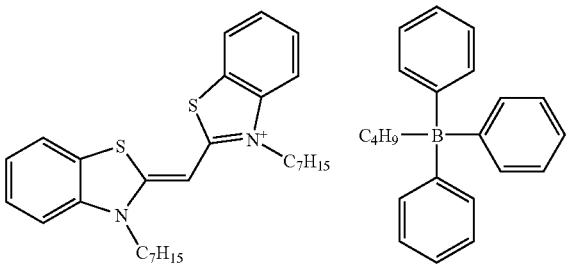

-continued
Dye-5
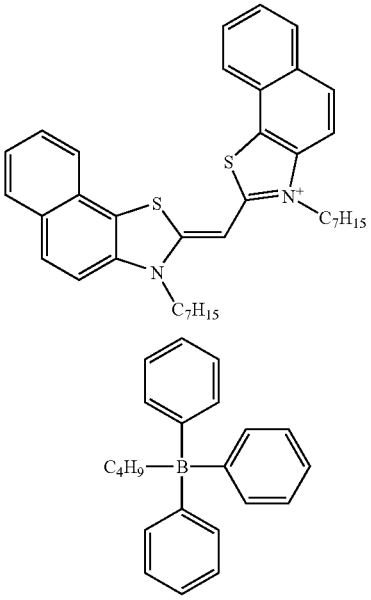
Dye-6
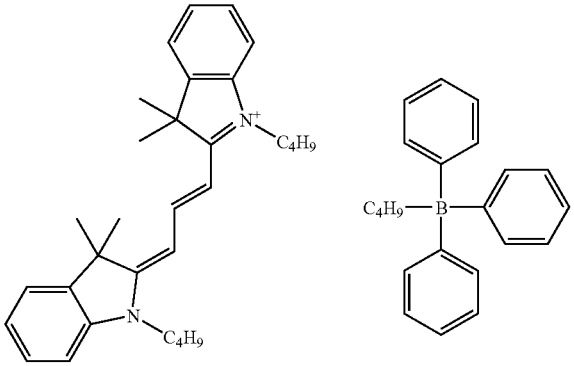
Dye-7
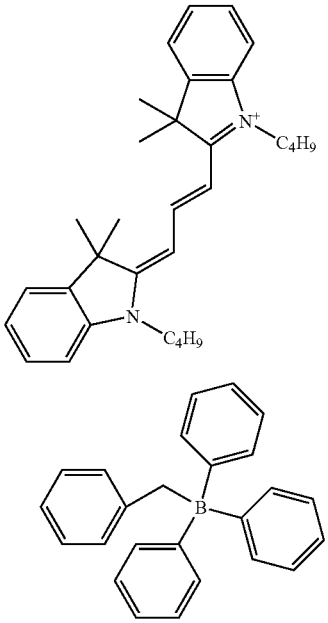
-continued
Dye-8
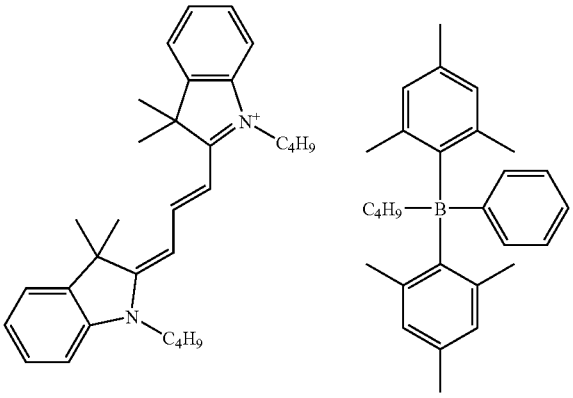
Dye-9
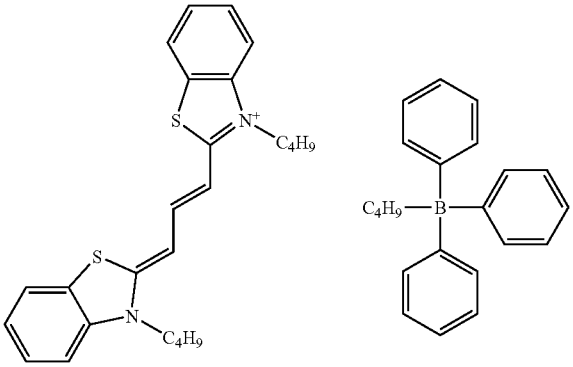
Dye-10
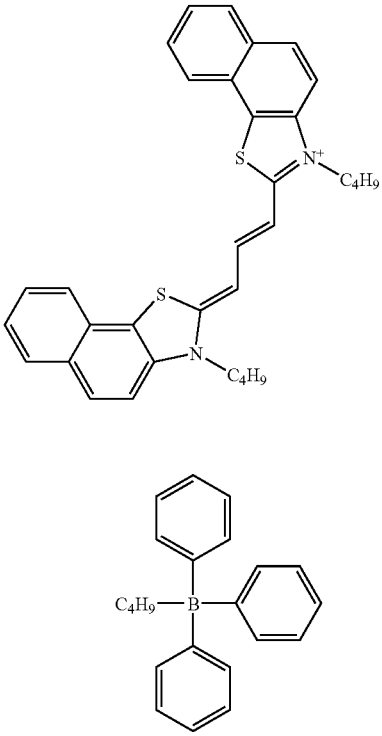

-continued
Dye-11
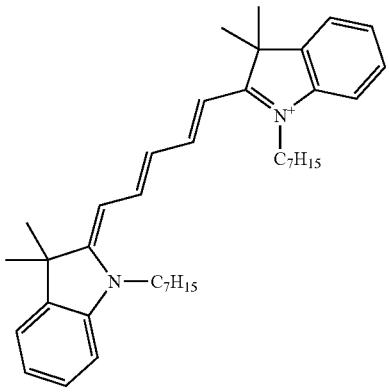
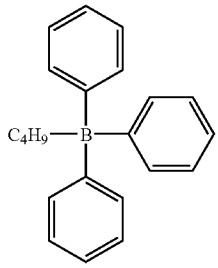
Dye-12
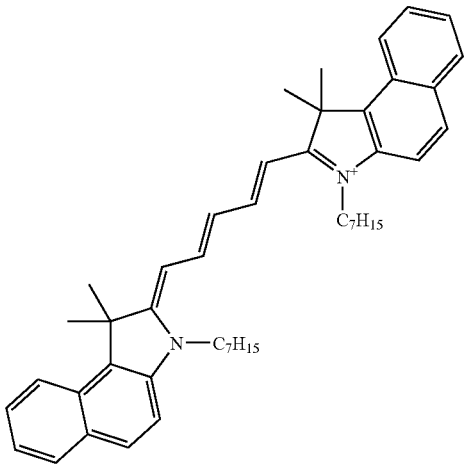
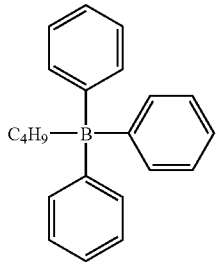
-continued
Dye-13
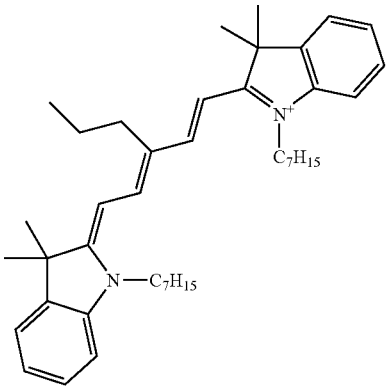
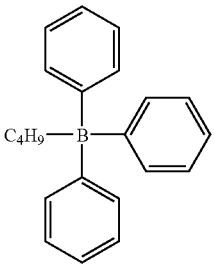
Dye-14
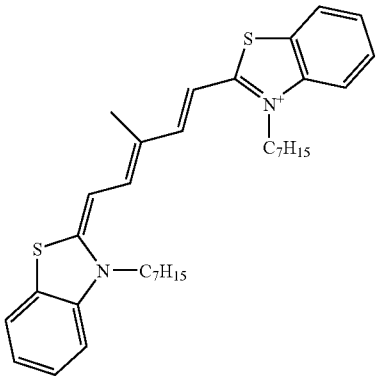
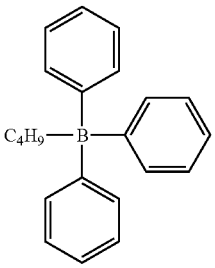

-continued
Dye-15
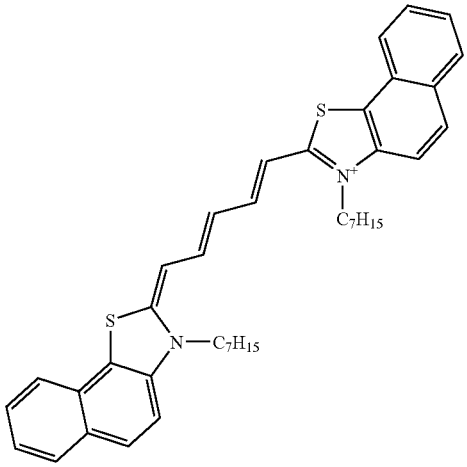
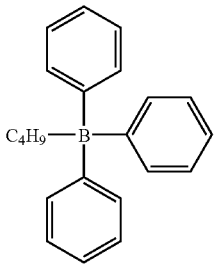
Dye-16
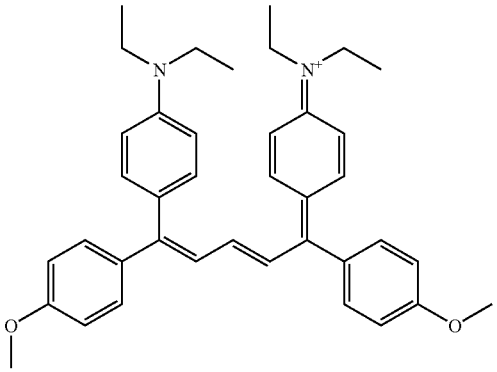
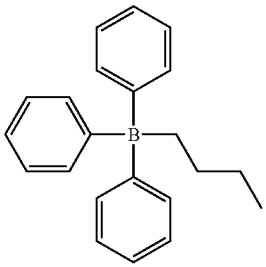
-continued
Dye-17
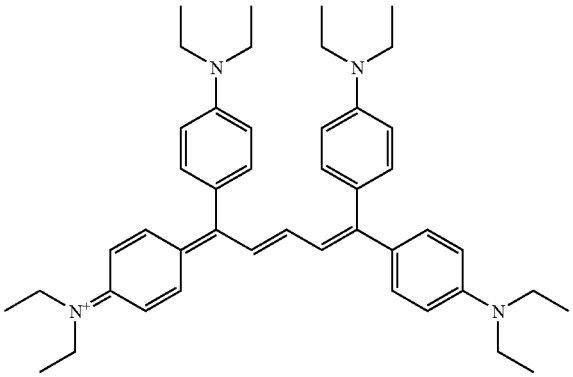
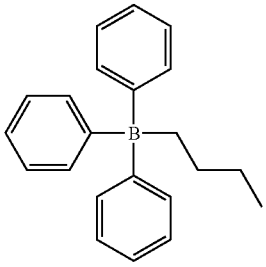
Dye-18
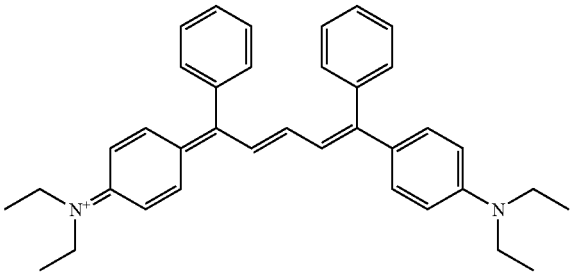
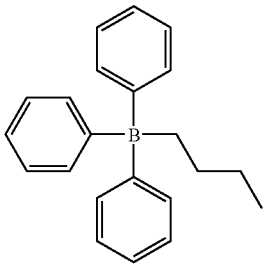

-continued

Dye-19

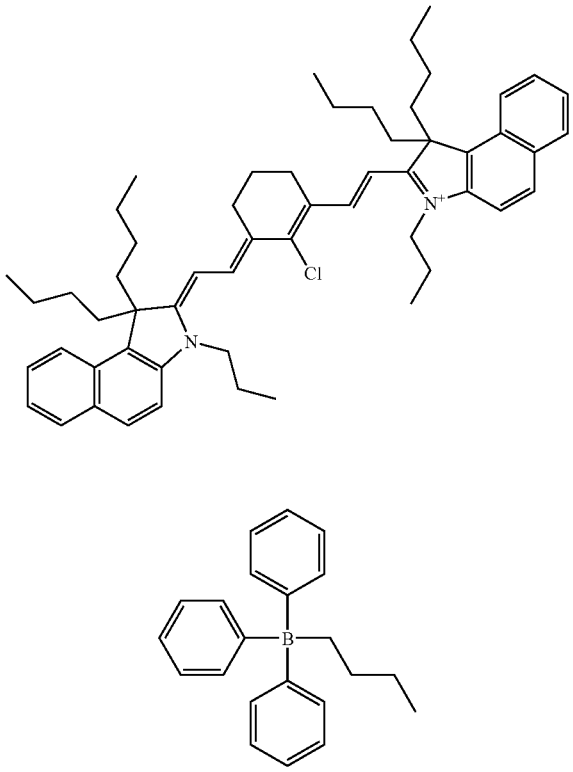

The borate salt useful for the photosensitive composition of the present invention is represented by the following general formula (1):

$$[BR_4]^-Z^+ \quad [I]$$

where Z represents a group capable of forming cation and is not light sensitive, and $[BR_4]^-$ is a borate compound having four R groups which are selected from an alkyl group, a substituted alkyl group, an aryl group, a substituted aryl group, an aralkyl group, a substituted aralkyl group, an alkaryl group, a substituted alkaryl group, an alkenyl group, a substituted alkenyl group, an alkynyl group, a substituted alkynyl group, an alicyclic group, a substituted alicyclic group, a heterocyclic group, a substituted heterocyclic group, and a derivative thereof. Plural Rs may be the same as or different from each other. In addition, two or more of these groups may join together directly or via a substituent and form a boron-containing heterocycle. $Z^+$ does not absorb light and represents an alkali metal, quaternary ammonium, pyridinium, quinolinium, diazonium, morpholinium, tetrazolium, acridinium, phosphonium, sulfonium, oxosulfonium, iodonium, S, P, Cu, Ag, Hg, Pd, Fe, Co, Sn, Mo, Cr, Ni, As, or Se.

Specific examples of the above-mentioned borate salts are given below. However, it should be noted that the present invention is not limited to these examples.

BS-1

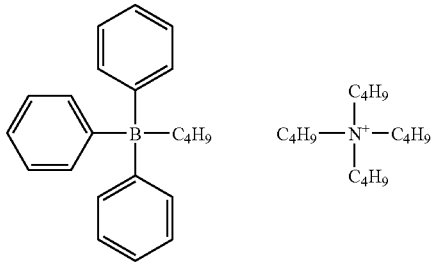

BS-2

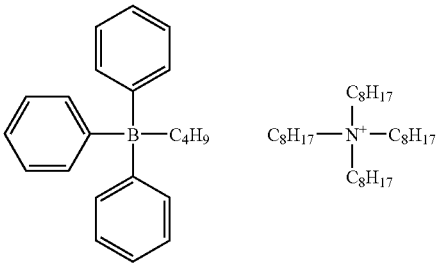

BS-3

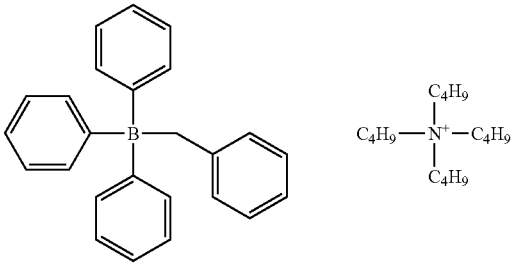

BS-4

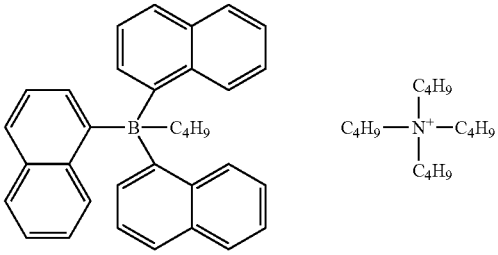

BS-5

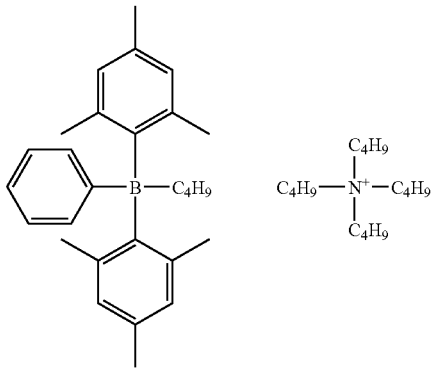

-continued
BS-6
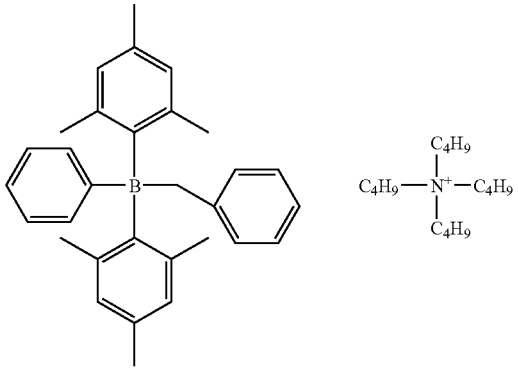
BS-7
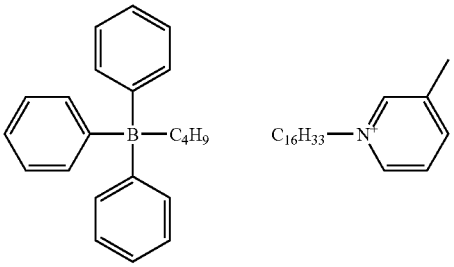
BS-8
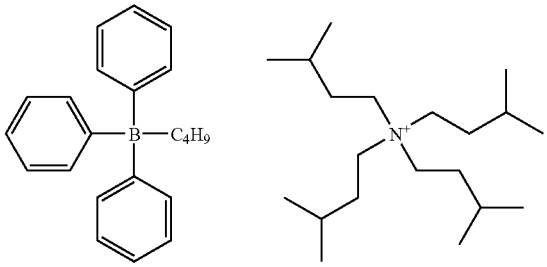
BS-9
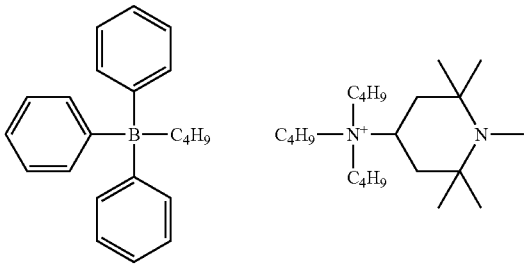
BS-10
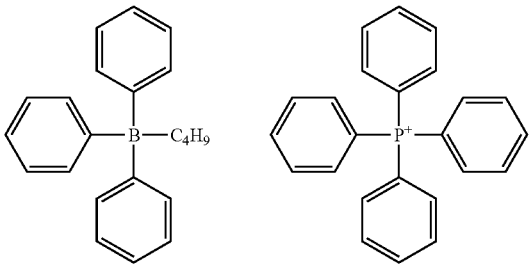
-continued
BS-11
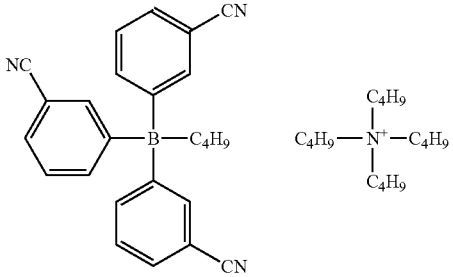
BS-12
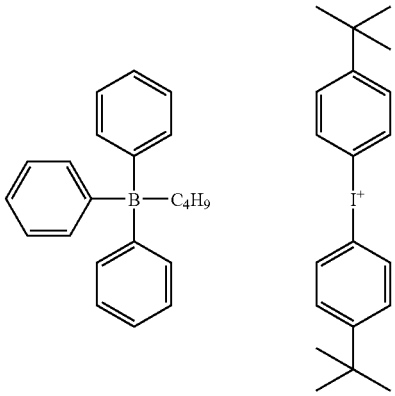
BS-13
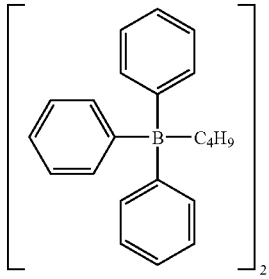
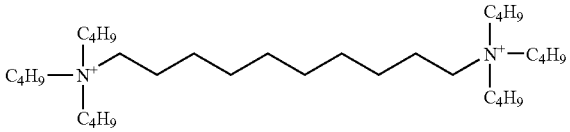
BS-14
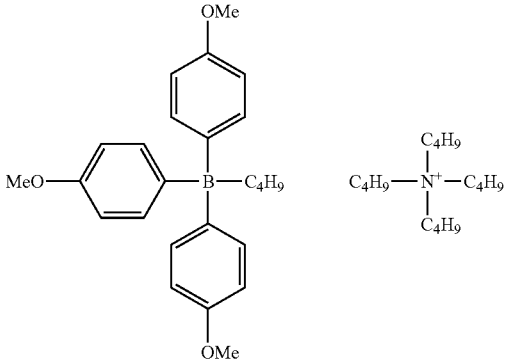

-continued

BS-15

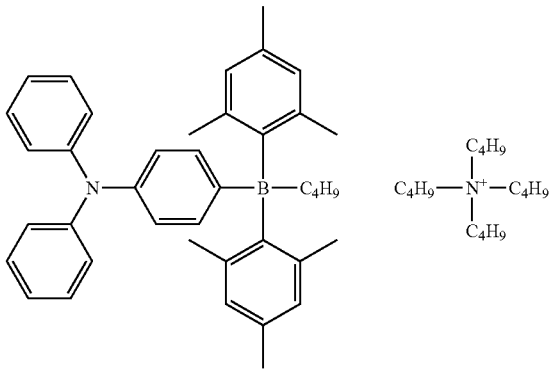

BS-16

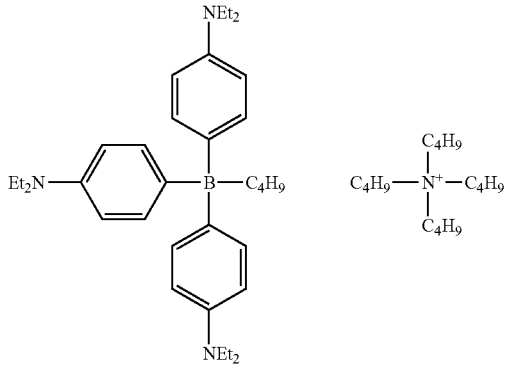

BS-17

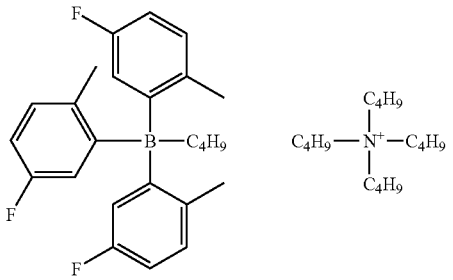

Various additives can be used together with the photoinitiator system to affect the polymerization rate. For example, a reducing agent such as an oxygen scavenger or a chain-transfer aid of an active hydrogen donor, or other compound can be used to accelerate the polymerization. An oxygen scavenger is also known as an autoxidizer and is capable of consuming oxygen in a free radical chain process. Examples of useful autoxidizers are N,N-dialkylanilines. Examples of preferred N,N-dialkylanilines are dialkylanilines substituted in one or more of the ortho-, meta-, or para-position by the following groups: methyl, ethyl, isopropyl, t-butyl, 3,4-tetramethylene, phenyl, trifluoromethyl, acetyl, ethoxycarbonyl, carboxy, carboxylate, trimethylsilymethyl, trimethylsilyl, triethylsilyl, trimethylgermanyl, triethylgermanyl, trimethylstannyl, triethylstannyl, n-butoxy, n-pentyloxy, phenoxy, hydroxy, acetyl-oxy, methylthio, ethylthio, isopropylthio, thio-(mercapto-), acetylthio, fluoro, chloro, bromo and iodo. Representative examples of N,N-dialkylanilines useful in the present invention are 4-cyano-N,N-dimethylaniline, 4-acetyl-N,N-dimethylaniline, 4-bromo-N,N-dimethylaniline, ethyl 4-(N,N-dimethylamino)benzoate, 3-chloro-N,N-dimethylaniline, 4-chloro-N,N-dimethylaniline, 3-ethoxy-N,N-dimethylaniline, 4-fluoro-N,N-dimethylaniline, 4-methyl-N,N-dimethylaniline, 4-ethoxy-N,N-dimethylaniline, N,N-dimethylaniline, N,N-dimethylthioanicidine, 4-amino-N,N-dimethylaniline, 3-hydroxy-N,N-dimethylaniline, N,N,N',N'-tetramethyl-1,4-dianiline, 4-acetamido-N,N-dimethylaniline, 2,6-diisopropyl-N,N-dimethylaniline (DIDMA), 2,6-diethyl-N,N-dimethylaniline, N,N,2,4,6-pentamethylaniline (PMA) and p-t-butyl-N,N-dimethylaniline. In accordance with another aspect of the invention, the dye borate photoinitiator is used in combination with a disulfide coinitiator.

Examples of useful disulfides are described in U.S. Pat. No. 5,230,982 which is incorporated herein by reference. Two of the most preferred disulfides are mercaptobenzothiazo-2-yl disulfide and 6-ethoxymercaptobenzothiazol-2-yl disulfide. By using these disulfides as described in the referenced patent, the amount of the photoinitiators used in the microcapsules can be reduced to levels such that the background coloration or residual stain can be reduced significantly. At these low levels, the low-density image area coloration of the imaging layer does not detract unacceptably from the quality of the image. In addition, thiols, thioketones, trihalomethyl compounds, lophine dimer compounds, iodonium salts, sulfonium salts, azinium salts, organic peroxides, and azides, are examples of compounds useful as polymerization accelerators.

Other additives which can be incorporated into the photopolymerization composition of the invention include various ultraviolet ray absorbers and hindered amine light stabilizers, photostabilizers as described in detail by J. F. Rabek in "Photostabilization of Polymers, Principles and Applications" published by Elsevier Applied Science in 1990.

The substantially colorless compound E, which reacts with the color-forming component A to develop a color, may or may not have a polymerizable group. For example, as described above, the substantially colorless compound E may be the same as the compound B having a polymerizable group or the same as the electron-accepting compound or the coupler compound listed as the compound C having no polymerizable group.

Preferably the above-mentioned substantially colorless component B, C, or E (developers), when added to the image forming unit of the present invention, is in a dispersion form prepared by technique such as sand mill in the presence of a water-soluble polymer, a sensitizer, and other color-forming aid. The dispersion can also be prepared by a process comprising the steps of dissolving these components in an organic solvent, blending the resulting solution with a polymer aqueous solution (i.e., aqueous phase) containing a surfactant and/or water soluble-polymer as protective colloids, and emulsifying the blend by such means as a homogenizer, and removing the organic solvent by evaporation so as to obtain a dispersion for use. Preferably the particle size of the dispersion is less than 5 μm, preferably less than 2 μm. Preferably the particle size is greater than 0.1 μm.

The imaging element of the invention comprises a support and above the support a light sensitive and heat developable image forming unit or light and pressure developable image forming unit. In one embodiment, a multicolor image can be realized using an imaging element produced by producing a plurality of single-color image forming layers within the image forming unit, each of which contains microcapsules enclosing a color-forming component A designed to form a different color, and irradiating the imaging element with a plurality of light sources each having a different wavelength.

That is, the light sensitive and heat developable imaging layer or light sensitive and pressure developable imaging layer has a structure produced by providing on a support a first imaging layer which contains microcapsules containing a color-forming component for developing a yellow color and a photopolymerization composition sensitive to a light source having a central wavelength of $\lambda_1$, providing on top of the first imaging layer a second imaging layer which contains microcapsules containing a color-forming component for developing a magenta color and a photopolymerization composition sensitive to a light source having a central wavelength of $\lambda_2$, and providing on top of second imaging layer a third imaging layer which contains microcapsules containing a color-forming component for developing a cyan color and a photopolymerization composition sensitive to a light source having a central wavelength of $\lambda_3$. In addition, if necessary, the imaging layer may have an intermediate layer between the different colored imaging layers. The above-mentioned central wavelengths $\lambda_1$, $\lambda_2$, and $\lambda_3$ of the light sources differ from each other.

The light sensitive and heat developable image forming unit layer or light sensitive and pressure developable image forming unit of the present invention may have any number of the imaging layers. Preferably, the imaging layer may contain first to $i^{th}$ layers, each layer is sensitive to light having a central wavelength different from the light having a central wavelength to which other layers are sensitive, and each layer develops a color different from that of other layers. For example, the first imaging layer is sensitive to light having a central wavelength of $\lambda_1$ and develops a color, a second imaging layer is sensitive to light having a central wavelength of $\lambda_2$ and develops a color different from the color of the first imaging layer, and an ith imaging layer is sensitive to light having a central wavelength of $\lambda_i$ and develops a color different from the colors of $i-1^{th}$ imaging layer.

The multicolor image can also be realized using an imaging element by producing a multicolor image forming unit in which all of the microcapsules are in one layer. The layer contains microcapsules of which each type contains a color-forming component A of a different color, is sensitive to light having a central wavelength different from the light having a central wavelength to which other types of microcapsules are sensitive, and develops a color different from the color other types develop. For example, the first type of microcapsule is sensitive to light having a central wavelength of $\lambda_1$ and develops a color, a second type is sensitive to light having a central wavelength of $\lambda_2$ and develops a color different from the color of the first type of microcapsules, and an i th type of microcapsules is sensitive to light having a central wavelength of $\lambda_i$ and develops a color different from the colors of $i-1^{th}$ type of microcapsules. In the present invention, i is preferably any integer selected from 1 to 10, more preferably any integer selected from 2 to 6, and most preferably any integer selected from 2 to 4.

When images are formed using an imaging material having a multicolor image forming unit like the one for use in the present invention, the exposure step consists of image-wise exposure using plural light sources whose wavelengths match the absorption wavelengths of the imaging layers, respectively, and are different from each other. This exposure enables the imaging layers whose absorption wavelengths match the wavelengths of the respective light sources to form latent images selectively. Because of this, multicolor images can be formed with a high sensitivity and in high sharpness. Furthermore, since the background, which is colored with such compounds as a spectral sensitizing compound and a photopolymerization initiator, can be decolorized by irradiating the imaging layer surface with light, high-quality images having a high contrast can be formed.

The light sensitive and heat developable or light sensitive and pressure developable image forming unit or imaging layers of the invention also contain a binder material. In one embodiment the image forming unit is non-chill settable. There is no limitation on the choice of the binder material as far as it is compatible with other components incorporated in the layer or unit. The binder material includes, for example, water-soluble polymers, water dispersible polymers, and latex. Specific examples include proteins, protein derivatives, cellulose derivatives (e.g,. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, and homopolymer or copolymers containing styrene sulfonic acid. Binder also include dispersions made of solvent soluble polymers such as polystyrene, polyvinyl formal, polyvinyl butyral, acrylic resins, e.g., polymethyl acrylate, polybutyl acrylate, polymethyl methacrylate, polybutyl methacrylate, and copolymers thereof, phenol resins, styrene-butadiene resins, ethyl cellulose, epoxy resins, and urethane resins, and latices of such polymers.

The binder is preferably cross-linked so as to provide a high degree of cohesion and adhesion. Cross-linking agents or hardeners which may effectively be used in the coating compositions of the present invention include aldehydes, epoxy compounds, polyfunctional aziridines, vinyl sulfones, methoxyalkyl melamines, triazines, polyisocyanates, dioxane derivatives such as dihydroxydioxane, carbodiimides, chrome alum, zirconium sulfate, and the like.

The light sensitive and heat developable or light sensitive and pressure developable image forming unit or imaging layer thereof may also contain various surfactants for such purposes as a coating aid, an antistatic agent, an agent to improve sliding properties, an emulsifier, an adhesion inhibitor.

Examples of the surfactant that can be used include nonionic surfactants such as saponin, polyethylene oxide, and polyethylene oxide derivatives, e.g., alkyl ethers of polyethylene oxide; anionic surfactants such as alkylsulfonates, alkylbenzenesulfonates, alkylnaphthalenesulfonates, alkylsulfuric esters, N-acyl-N-alkyltaurines, sulfosuccinic esters, and sulfoalkylpolyoxyethylene alkylphenyl ethers; amphoteric surfactants such as alkylbetaines and alkylsulfobetaines; and cationic surfactants such as aliphatic or aromatic quaternary ammonium salts.

Furthermore, if necessary the light and heat sensitive or light sensitive and pressure developable image forming unit or an imaging layer thereof may contain additives other than those described above. For example, dyes, ultraviolet absorbing agents, plasticizers, fluorescent brighteners, matting agents, coating aids, hardeners, antistatic agents, and sliding property-improving agents. Typical examples of these additives are described in *Research Disclosure*, Vol. 176 (December 1978, Item 17643) and *Research Disclosure*, Vol.187 (November 1979, Item 18716).

In the imaging element of the present invention, the imaging material uses color-forming component A which is encapsulated in microcapsules. For the encapsulation, a conventionally known method can be employed. Examples of the method include a method utilizing coacervation of a hydrophilic wall-forming material described in U.S. Pat. Nos. 2,800,457 and 2,800,458; an interfacial polymerization method described in U.S. Pat. No. 3,287,154; U.K. Patent 990,443; and JP-B Nos. 38–19574; 42–446; and 42–771; a method utilizing polymer deposition described in U.S. Pat. Nos. 3,418,250 and 3,660,304; a method utilizing an isocyanate-polyol wall forming material described in U.S. Pat. No. 3,796,669; a method utilizing an isocyanate wall forming material described in U.S. Pat. No. 3,914,511; a method utilizing urea-formaldehyde and urea-formaldehyde-resorcinol wall-forming materials described in U.S. Pat. Nos. 4,001,140; 4,087,376; and 4,089,802; a method utilizing wall-forming materials such as a melamine-formaldehyde resin and hydroxypropylcellulose described in U.S. Pat. No. 4,025,455; an in-situ method utilizing a polymerization of monomers described in JP-B No. 36-9168 and JP-A No. 51-9079; a method utilizing electrolytic dispersion cooling described in U. K. Patents 952,807 and 965,074; and a spray-drying method described in U.S. Pat. No. 3,111,407 and U. K. Patent 930,442.

The encapsulating method is not limited to the methods listed above. However, in the imaging material of the present invention, it is particularly preferable to employ an interfacial polymerization method comprising the steps of mixing an oil phase, prepared by dissolving or dispersing the color-forming component in a hydrophobic organic phase that becomes the core of the microcapsules, and an aqueous phase having a water-soluble polymer dissolved therein, emulsifying the mixture by means of a homogenizer or the like, and heating the emulsion so as to cause a polymer-forming reaction at the interface of droplets so that polymeric microcapsule walls are formed. This method makes it possible to form microcapsules having uniform particle diameters in a short period of time and to obtain a imaging material excellent in storability as a raw imaging material.

The reactants that form the polymer are added to the inside of the droplets and/or the outside of the droplets. Examples of the polymeric substance include polyurethane, polyurea, polyamide, polyester, polycarbonate, urea/formaldehyde resins, melamine resins, polystyrene, styrene/methacrylate copolymers, styrene/acrylate copolymers, and so on. Among these substances, polyurethane, polyurea, polyamide, polyester, and polycarbonate are preferable, and polyurethane and polyurea are particularly preferable. The above-listed polymeric substances may be used in combinations of two or more kinds.

The water-soluble polymer, which is present as protective colloids in the aqueous phase to be mixed with the oil phase, may be selected appropriately from conventionally known anionic polymers, nonionic polymers, and amphoteric polymers. Examples of the anionic polymer that can be used include natural ones and synthetic ones. Some examples are polymers having such groups as —COO—, —$SO_2$—, and the like. Specific examples thereof include naturally occurring substances such as gum arabic, alginic acid, and pectin; semisynthetic products such as carboxymethyl cellulose, gelatin derivatives, e.g., phthalated gelatin, sulfated starch, sulfated cellulose, and ligninsulfonic acid; and synthetic products such as maleic anhydride-based (including hydrolysate) copolymers, acrylic acid-based (including methacrylic acid-based) polymers and copolymers, vinylbenzenesulfonic acid-based polymers and copolymers, and carboxy-modified polyvinyl alcohol. Examples of the nonionic polymer include polyvinyl alcohol, hydroxyethyl cellulose, and methylcellulose. Examples of the amphoteric polymer include gelatin, and the like. The water-soluble polymers are used as 0.01 to 10% by mass solutions.

A surfactant can also be incorporated in the aqueous phase. The surfactant can be suitably selected from anionic or nonionic surfactants that do not cause precipitation or flocculation by interacting with the protective colloids. Preferred examples of the surfactant include sodium alkylbenzenesulfonate, sodium alkylsulfate, sodium dioctylsulfosuccinate, and polyalkylene glycol (e.g., polyoxyethylene nonylphenyl ether).

When polyurethane is used as a microcapsule wall material, the microcapsule wall can be formed by mixing a polyvalent isocyanate and a second substance (e.g., polyol or polyamine) that reacts therewith to form the microcapsule wall in a water-soluble polymer aqueous solution (i.e., aqueous phase) or in an oily medium (oil phase) to be encapsulated, emulsifying the mixture, and heating the resulting emulsion so as to cause a polymer-forming reaction at the interface of droplets. As the polyvalent isocyanate and the polyol or polyamine, with which the polyvalent isocyanate reacts, those which are described in U.S. Pat. Nos. 3,281,383; 3,773,695; and 3,793,268; and JP-B Nos. 48-40347 and 49-24159, and JP-A Nos. 48-80191 and 48-84086 can be used.

When microcapsules containing the color-forming component are prepared, the color-forming component to be enclosed in the microcapsules may be present in a solution state or may be present in solid state inside the microcapsules at room temperature. If it is in the solution state, the color-forming component is mixed with an organic solvent having high boiling point to form the microcapsule core. If it is in the solid states, the color former is dissolved in a thermal solvent or an auxiliary solvent. An auxiliary solvent is removed after encapsulation. The microcapsule core comprises mostly the color-forming component together with other additives. The thermal solvent is a solid at room temperature and becomes a liquid at elevated temperatures, for example, at curing temperatures during the encapsulation process. In this case, the microcapsule core comprises the color-forming component dispersed in a thermal solvent.

A thermal solvent in this invention is defined as compounds which is a solid at temperatures of less than 30° C., and become a liquid at temperatures of greater than 30° C., preferably greater than 40° C. Typical thermal solvents include 1,12-dihydroxydodecane, paraffin wax, bees wax, fatty acid, fatty acid amide, stearic acid, steramide, zinc stearate, and more preferably hindered phenols such as 2,6-di-t-butyl-4-methylphenol (BHT), thiodiethylene hydrocinnamate (IRGANOX™ 1035 from Ciba-Geigy Corp.) tetrakis methane (IRGANOX™ 1010 from Ciba Geigy Corp.), bisphenol A diacetate (BPADA), diphenyl phthalate, dicyclohexyl phthalate,' diphenyl oxalate, benzyl oxynaphthalene, 1-hydroxy-2-naphthoate,- rosin and m terphenyl derivatives, bis-dialkylaryl ethane such as 1,2-bis(3,4-dimethylphenyl)ethane, those disclosed in U.S. Pat. Nos. 4,885,271 and 4,885,271.

In a preferred embodiment of the invention, the color-forming component is mixed together with a photopolymerization composition to form the microcapsule core, or microcapsule internal phase. The microcapsule shell or the microcapsule wall material is a polyurea, or polyurethane-urea. In another preferred embodiment of the invention, the color-forming component is mixed together with a photolymerization composition to form the microcapsule core, or microcapsule internal phase. The microcapsule shell or the microcapsule wall material comprises a polyurea shell or a polyurethane-urea shell and a melamine-formaldehyde or urea-formaldehyde shell.

Preferably the microcapsule containing the color-forming component A is prepared by the steps of dissolving the color-forming component A in an auxiliary organic solvent such as ethyl acetate, or a thermal solvent, or the a photopolymerization composition to form a solution, adding to the solution a certain amount of a microcapsule wall material such as a polyfunctional isocynate to form the oil phase, adding the oil phase to an aqueous solution comprising a water soluble polymer such as polyvinyl alcohol or phthalated gelatin as the protective colloid, and optionally a surfactant, to form a mixture, emulsifying the mixture with a homogenizer to form an emulsion, optionally adding to the emulsion a polyfunctional amine as the curing agent, and curing the emulsion at elevated temperature to form the microcapsule.

If it is desirable to form a second shell, an aqueous solution of melamine and formaldehyde or a precondensate is added to the above emulsion. The melamine-formaldehyde shell is formed by raising the temperature of the resulting mixture at neutral or acidic pH, e.g., pH of 7 or less. The temperature of encapsulation is maintained at about 20 to 95° C., preferably about 30 to 85° C., and more preferably about 45 to 80° C.

The average particle diameter of the microcapsules for use in the imaging material of the present invention is preferably 20 μm or less, more preferably 10 μm or less, and most preferably 6 μm or less from the standpoint of obtaining high resolution. The average particle diameter is preferably 0.1 μm or greater because, if the average particle diameter of the microcapsules is too small, the surface area per unit amount of the solid components becomes larger and a lager amount of wall-forming materials is required.

Examples of the support for use in the imaging material of the present invention include paper; coated paper; synthetic paper such as laminated paper; films such as polyethylene terephthalate film, cellulose triacetate film, polyethylene film, polystyrene film, and polycarbonate film; plates of metals such as aluminum, zinc, and copper; and these supports whose surface is treated with a surface treatment, a subbing layer or metal vapor deposition. A further example is the support described in *Research Disclosure*, Vol. 200 (December 1980, Item 20036 XVII). These supports may contain a fluorescent brightener, a bluing dye, a pigment, or other additives. Furthermore, the support itself may be made of an elastic sheet such as a polyurethane foam or rubber sheet. Between a support and the light sensitive and heat developable or the light sensitive and pressure developable image forming unit, a layer, which comprises a polymer such as gelatin, polyvinyl alcohol (PVA), or the like having a low oxygen transmission rate, can be provided. The presence of this layer makes it possible to effectively prevent the fading due to photooxidation of the images formed.

The image element of the present invention can contain at least one electrically conductive layer, which can be either surface protective layer or a sub layer. The surface resistivity of at least one side of the support is preferably less than $1\times10^{12}$ Ω(ohms)$^{-}$/square, more preferably less than $1\times10^{11}$ Ω$^{-}$/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The image element of the invention can contain a curl control layer or a backing layer located opposite of the support to the imaging forming unit for the purposes of improving the machine-handling properties and curl of the recording element, controlling the friction and resistivity thereof, and the like. Typically, the backing may comprise a binder and a filler and optionally a lubricant. Typical fillers include amorphous and crystalline silicas, poly(methyl methacrylate), hollow sphere polystyrene beads, micro-crystalline cellulose, zinc oxide and talc. The filler loaded in the backing is generally less than 5 percent by weight of the binder component and the average particle size of the filler material is in the range of 1 to 30 μm. Examples of typical binders used in the backing are polymers such as polyacrylates, gelatin, polymethacrylates, polystyrenes, polyacrylamides, vinyl chloride-vinyl acetate copolymers, poly(vinyl alcohol), gelatin and cellulose derivatives. Lubricants can be same as those incorporated in the outer protective layer located in the opposite side to the backing layer. Additionally, an antistatic agent also can be included in the backing to prevent static hindrance of the image element. Particularly suitable antistatic agents are compounds such as dodecylbenzenesulfonate sodium salt, octylsulfonate potassium salt, oligostyrenesulfonate sodium salt and laurylsulfosuccinate sodium salt, and the like. The antistatic agent may be added to the binder composition in an amount of 0.1 to 20 percent by weight, based on the weight of the binder. An image forming unit may also be coated on the backside, if desired.

Visible images can be made by heat development if the imaging element of the present invention is a light sensitive and heat-developable imaging element or by pressure development if the imaging element of the present invention is a light sensitive and pressure developable imaging material. The heat or pressure development can be carried out either simultaneously with the exposure for latent image formation or after the exposure.

A conventionally known heating method can be employed for the heat development. Generally, the heating temperature is preferably 80 to 200° C., more preferably 83 to 160° C., and most preferably 85 to 130° C. The duration of heating is preferably in the range of 3 seconds to 1 minute, more preferably in the range of 4 to 45 seconds, and most preferably in the range of 5 to 30 seconds. The pressure development can be accomplished with a pressure applicator device. For example, the imaging material is developed by passing an exposed imaging media between a pair of calendar rollers that rupture the microcapsules, thereby allowing contact between the color-forming component and a developer that react to develop the image. The imaging material can also be developed by moving a point contact which is resiliently biased into engagement with the imaging sheet. Typically, the imaging sheet is secured to a cylinder and the point contact is positioned in resilient pressure contact with the imaging sheet. As the cylinder is rotated, the point contact is simultaneously moved along the cylinder in synchronism with the rotation of the cylinder to rupture the microcapsules and develop the image in the imaging sheet, or the imaging sheet may be mounted on a planer platform and the point contact is moved across the surface of the sheet using a screw thread in an X-Y transport device. The pressure that is to be applied is preferably 10 to 300 kg/cm$^2$, more preferably 80 to 250 kg/cm$^2$, and most preferably 130 to 200 kg/cm$^2$. If the pressure is less than 10 kg/cm$^2$, sufficient density of developed color may not be obtained, whereas, if the pressure exceeds 300 kg/cm$^2$, the discrimination of the images may not be sufficient because even the hardened microcapsules are broken.

The imaging element of the present invention comprises a photopolymerization initiator or the like such as a spectral sensitizing. Therefore, the imaging element of the present invention is colored with the photopolymerization initiator or the like. Since background is also colored with the compound, it is very important for the method of the present invention that the colored background is decolorized by irradiation after heat development. Accordingly, it is preferable that, after the heat development, the image forming unit surface is irradiated with light to fix the images formed and to decolorize, decompose, or deactivate the components such as a spectral sensitizing compound which remain in the imaging layer and decrease the whiteness of the background. By carrying out the irradiation, it is possible to inhibit the coloration reaction. As a result, the density variation in the images can be inhibited and the image storability can be largely enhanced.

The imaging element of the invention is exposed image-wise to light according to the pattern of a desired image shape so that the photopolymerization forms a latent image. The color development step is accomplished by heat or/and pressure so that the color-forming components develop colors according to the latent image to thereby produce images. The fixing step in which the imaging layer surface is irradiated with light so as to fix the image formed and decolorize the organic dyes.

In the exposure step, it is possible to employ, for example, a means for exposing the whole face to an amount of light which has wavelengths corresponding to the sensitive regions of respective colors and can provide a desired density of the developed color. The light source for use in the exposure step may be any light source selected from the light sources having wavelengths ranging from ultraviolet to infrared light if the light sensitive and heat developable imaging layer contains a light-absorbing material such as a spectral sensitizing compound that exhibits an absorption in a specific wavelength region. More specifically, a light source providing maximum absorption wavelengths ranging from 300 to 1000 nm is preferable. It is preferable to select and use a light source whose wavelength matches the absorption wavelength of the light-absorbing material such as an organic dye to be used. The selective use of such light-absorbing material enables the use of a blue to red light source and the use of a small-sized, inexpensive infrared laser device and consequently not only broadens the use of the imaging material of the present invention but also raises sensitivity and image sharpness. Among the light sources, it is particularly preferable to use a laser light source such as a blue, greens or red laser light source or an LED from the viewpoint of simplicity, downsizing, and low cost of the device.

According to the imaging process of the present invention, after the color development step, the image forming unit surface is subjected to a fixing step in which the whole imaging layer surface is irradiated with light from a specific light source to fix the images formed and to decolorize photopolymerization initiator components remaining in the imaging layer. As for the light source that can be used in the fixing step, a wide range of light sources, such as a mercury lamp, an ultrahigh pressure mercury lamp, an electrodeless discharge-type mercury lamp, a xenon lamp, a tungsten lamp, a metal halide lamp, and a fluorescent lamp, can be suitably used. The method of irradiating the image forming unit with light from the light source in the fixing step is not particularly limited. The whole image forming unit surface may be irradiated with light at one time or the image forming unit surface may be gradually irradiated with light by scanning or the like until the irradiation of the surface finally ends. That is, any method that finally enables the irradiation of the entire surface of the image forming unit material after image formation with nearly uniform light may be employed. The irradiation of the entire image forming unit layer is preferable from the standpoint of the enhancement of the effects of the present invention.

The duration of the irradiation with light from the light source needs to be the time period that allows the produced images to be fixed and the background to be sufficiently decolorized. In order to perform sufficient fixing of images and decolorization, the duration of the irradiation is preferably in the range of several seconds to tens of minutes and more preferably in the range of several seconds to several minutes.

The thermal dye imaging element i.e.—receiving layer of the receiving elements used with the invention may comprise, for example, a polycarbonate, a polyurethane, a polyester, polyvinyl chloride, poly(styrene-co-acrylonitrile), poly(caprolactone), or mixtures thereof. The dye image-receiving layer may be present in any amount that is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al.

Dye-donor elements that are used with the dye-receiving imaging element conventionally comprise a support having thereon a dye containing layer. Any dye can be used in the dye-donor employed with the invention, provided it is transferable to the dye-receiving layer by the action of heat. Especially good results have been obtained with sublimable dyes. Dye donors applicable for use with the present invention are described, e.g., in U.S. Pat. Nos. 4,916,112; 4,927,803; and 5,023,228. As noted above, dye-donor elements are used to form a dye transfer image. Such a process comprises image-wise-heating a dye-donor element and transferring a dye image to a dye-receiving element as described above to form the dye transfer image. In a preferred embodiment of the thermal dye transfer method of printing, a dye donor element is employed which compromises a poly(ethylene terephthalate) support coated with sequential repeating areas of cyan, magenta, and yellow dye, and the dye transfer steps are sequentially performed for each color to obtain a three-color dye transfer image. When the process is only performed for a single color, then a monochrome dye transfer image is obtained.

Thermal printing heads, which can be used to transfer dye from dye-donor elements to receiving elements, are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal dye transfer may be used, such as lasers as described in, for example, GB No. 2,083,726A.

A thermal dye transfer assemblage comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in the prior art. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps, the use of liquid toners in place of dry toners is simply one of those variations.

The first basic step, creation of an electrostatic image, can be accomplished by a variety of methods. In one form, the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent, these toners form a film bonded to the paper. For heat-fusible toners, thermoplastic polymers are used as part of the particle. Heating both removes residual liquid and fixes the toner to paper.

When used as inkjet imaging media, the imaging elements or media typically comprise a substrate or a support material having on at least one surface thereof an ink-receiving or image-forming layer. If desired, in order to improve the adhesion of the ink receiving layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, can be applied to the surface of the support. The ink receiving layer is preferably coated onto the support layer from water or water-alcohol solutions at a dry thickness ranging from 3 to 75 μm, preferably 8 to 50 μm.

Any known inkjet receiver layer can be used with the present invention. For example, the ink receiving layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, and the like, derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly(ethylene imine), poly(acrylic acid), poly(methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the substrate and in various combinations within a layer.

A porous structure may be introduced into ink receiving layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This is especially true for photographic quality prints, in which porosity may cause a loss in gloss. In particular, the ink receiving layer may consist of any hydrophilic polymer or combination of polymers with or without additives as is well known in the art.

If desired, the ink receiving layer can be overcoated with an ink-permeable, anti-tack protective layer such as, for example, a layer comprising a cellulose derivative or a cationically-modified cellulose derivative or mixtures thereof. An especially preferred overcoat is poly β-1,4-anhydro-glucose-g-oxyethylene-g-(2'-hydroxypropyl)-N,N-dimethyl-N-dodecylammonium chloride. The overcoat layer is non porous, but is ink permeable and serves to improve the optical density of the images printed on the element with water-based inks. The overcoat layer can also protect the ink receiving layer from abrasion, smudging, and water damage. In general, this overcoat layer may be present at a dry thickness of about 0.1 to about 5 μm, preferably about 0.25 to about 3 μm.

In practice, various additives may be employed in the ink receiving layer and overcoat. These additives include surface active agents such as surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers, and the like. In addition, a mordant may be added in small quantities (2%–10% by weight of the base layer) to improve waterfastness. Useful mordants are disclosed in U.S. Pat. No. 5,474,843.

The DRL (dye receiving layer) is coated over the tie layer or TL at a thickness ranging from 0.1–10 μm, preferably 0.5–5 μm. There are many known formulations, which may be useful as dye receiving layers. The primary requirement is that the DRL is compatible with the inks, which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al in U.S. Pat. Nos. 4,879,166; 5,264,275; 5,104,730; 4,879,166; and Japanese Patents 1,095,091; 2,276,671; 2,276,670; 4,267,180; 5,024,335; and 5,016,517 disclose aqueous based DRL formulations comprising mixtures of psuedo-bohemite and certain water soluble resins. Light in U.S. Pat. Nos. 4,903,040, 4,930,041; 5,084,338; 5,126,194; 5,126,195; and 5,147,717 discloses aqueous-based DRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable DRL formulations based on poly(vinyl alcohol). Iqbal in U.S. Pat. No. 5,208,092 discloses water-based DRL formulations comprising vinyl copolymers, which are subsequently cross-linked. In addition to these examples, there may be other known or contemplated DRL formulations, which are consistent with the aforementioned primary and secondary requirements of the DRL.

The preferred DRL is 0.1–10 μm thick and is coated as an aqueous dispersion of 5 parts alumoxane and 5 parts poly (vinyl pyrrolidone). The DRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants. UV absorbing compounds, light stabilizers, and the like.

It may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes. i.e. continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements used with the present invention are water-based, such as those currently sold for use in the Hewlett-Packard Desk Writer® 560C printer. However, it is intended that alternative embodiments of the image-recording elements as described above, which may be formulated for use with inks which are specific to a given ink-recording process or to a given commercial vendor.

The silver halide photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful with this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds. e.g., allyl isothiocyanate, sodium thiosulfate and allyl thiourea, reducing agents, e.g., polyamines and stannous salts, noble metal compounds, e.g., gold, platinum, and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized with this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride, and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements used in the invention may utilize emulsions as described in *The Theory of the Photographic Process*, Fourth Edition. T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals, which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives, tin compounds, polyamine compounds, and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements used with this invention may use emulsions doped with Group VII metals such as iridium, rhodium, osmium, and iron as described in *Research Disclosure*, September 1994, Item 36544, Section 1, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element comprises the invention laminated support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 μm.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by KennethMason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the silver halide elements of the invention. The Table and its cited references also describe suitable ways of preparing exposing, processing and manipulating the elements, and the images contained therein. Photographic elements and methods of processing such elements particularly suitable for use with this invention are described in *Research Disclosure*, February 1995, Item 37038, and in *Research Disclosure*, September 1997, Item 40145 published by Kenneth Mason Publications, Ltd., Dudley Annex, 12a North Street, Emsworth, Hampshire PO10 7DQ, ENGLAND, the disclosures of which are incorporated herein by reference.

| Reference | Section | Subject Matter |
|---|---|---|
| 1 | I, II | Grain composition, morphology and |
| 2 | I, II, IX, X, XI, XII, XIV, XV | preparation. Emulsion preparation including hardeners, coating aids, |
| 3 & 4 | I, II, III, IX A & B | addenda, etc. |
| 1 | III, IV | Chemical sensitization and spectral |
| 2 | III, IV | sensitization/desensitization |
| 3 & 4 | IV,V | |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering materials; |
| 2 | VIII, XIII, XVI | Antistatic layers; matting agents |
| 3 & 4 | VIII, IX C & D | |
| 1 | VII | Image-couplers and image-modifying |
| 2 | VII | couplers; Wash-out couplers; Dye |
| 3 & 4 | X | stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4®. (Eastman Kodak Company) process or other processing systems suitable for developing high chloride emulsions. This invention is also directed towards a photographic recording element comprising a support and at least one light sensitive silver halide emulsion layer comprising silver halide grains as described above.

In another embodiment, imaging media useful with the present invention that provide a stiff and very smooth white base may be used as an imaged label or sticker print. Application of an adhesive layer by means known to those skilled in the art would provide a means of converting the imaging base into an imaged self-adhesive label or print. The adhesive layer could be permanent or repositionable. The adhesive may be coated or otherwise applied on the oriented core followed by the extrusion of the flange layer over the adhesive or the adhesive could be applied to an extruded flange layer.

A release liner that covers the adhesive could also be added in order to carry the material through necessary imaging processes, such as photofinishing. A release sheet of a tear-resistant polymer would produce a release sheet that would be easily removable. A self-adhesive sticker print or label could be used with any of the previously described imaging technologies including silver halide, inkjet, thermal dye transfer or electrophotography.

Examples of the present invention will be explained below. However, it should be noted that the present invention is not limited to these examples.

EXAMPLES

Example 1

Preparation of Multilayer Element 1

A water-absorbing layer P consisting of gelatin, LP-1 and hardener bis(vinylsulfonyl methane) at the weight ratio of 100:100:3 was coated by slide hopper onto a moving white opaque support (8 mil Granwell Polylith GC2 oriented polypropylene synthetic paper having polyolefin resin coated layers on both sides) that had been previously corona discharge treated. The web was passed through a chilled section of 4°–6° C. to immobilize the coating solution, followed by a series of drying sections to remove the excess water. The thickness of the resulting dry layer is approximately 16 μm.

Coating solutions for the multilayer coating process of this invention to produce Element 1 were prepared by mixing all the components described below in water. The gelatin used in layer 2 and layer 3 is acid processed ossein from Croda. Coating solutions for Layer 2 and Layer 3 were prepared at 50° C. Preparation of the coating solution for the light and pressure sensitive Layer 1 has previously been described in detail in U.S. 2002/0045121 A1, and it was prepared at room temperature.

Element 1

| | Component | Laydown (g/m$^2$) |
|---|---|---|
| Layer 3 | Gelatin | 1.08 |
| | Polydimethylsiloxane | 0.04 |
| | SF-1 | 0.02 |
| | SF-2 | 0.01 |
| | Triton X-200 ™ | 0.02 |
| | Ludox AM ™ | 0.27 |
| | Wet Laydown | 8.07 |
| Layer 2 | Gelatin | 3.23 |
| | LP-1 | 3.23 |
| | UV-1/UV-2 (@ 15/85 wt ratio) | 0.43 |
| | SF-1 | 0.01 |
| | Wet Laydown | 39.83 |

-continued

| | Component | Laydown (g/m$^2$) |
|---|---|---|
| Layer 1 | Cyan Caps | 2.51 |
| | Magenta Caps | 2.51 |
| | Yellow Caps | 2.51 |
| | Styrenic zinc salicylate developer | 12.92 |
| | Airflex 465 ™ | 1.55 |
| | Wet Laydown | 73.41 |

Structures of components used in Element 1:

UV-1

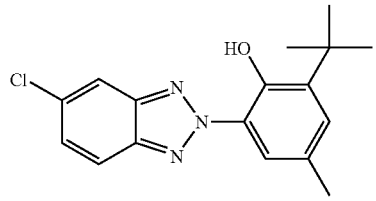

UV-2

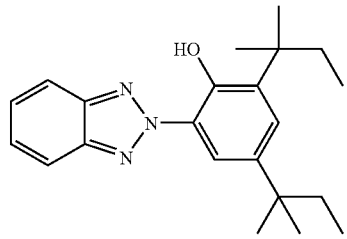

SF-1

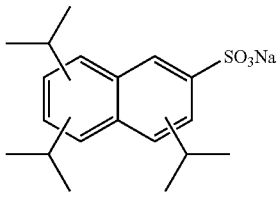

SF-2

$CF_3 \cdot (CF_2)_7 \cdot SO_3Na$

SF-3

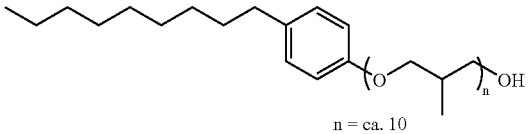

n = ca. 10

LP-1

Poly(butyl acrylate) latex
(Tg = −45° C., average particle size = 67 nm)

On top of the synthetic support that was pre-coated with water-absorbing layer P as described previously, coating solutions for Layer 1, Layer 2, and Layer 3 were coated simultaneously by a multi-slot slide hopper, with Layer 1 being at the bottom and Layer 3 on the top. After coating, the resulting multilayer structure was chill-set at 4°–6° C. and dried gradually in conditions that varied from 13° C. to 30° C. so that the coating solutions stayed immobilized.

Example 2

Preparation of Elements 2 to 4

Elements 2 to 4 were prepared similarly to Element 1, except that the composition and wetload of Layer 2 were different, as listed below.

| | Component | Laydown (g/m$^{2)}$ |
|---|---|---|
| Layer 2 of Element 2 | APO Gelatin | 3.23 |
| | UV-1/UV-2 (@ 15/85 wt ratio) | 0.43 |
| | LP-2 | 3.23 |
| | SF-1 | 0.01 |
| | Wet Laydown | 30.14 |
| Layer 2 of Element 3 | APO Gelatin | 4.84 |
| | UV-1/UV-2 (@ 15/85 wt ratio) | 0.43 |
| | LP-2 | 1.61 |
| | SF-1 | 0.01 |
| | Wet Laydown | 30.14 |
| Layer 2 of Element 4 | APO Gelatin | 2.15 |
| | UV-1/UV-2 (@ 15/85 wt ratio) | 0.43 |
| | LP-2 | 2.15 |
| | SF-1 | 0.01 |
| | Wet Laydown | 21.53 |

LP-2 is an acrylic emulsion polymer Aroset 3240™, available from Ashland Specialty Chemical Company (Columbus, Ohio), having a glass transition temperature of ~−35° C., and an average particle size of 345 nm.

| Element | Layer 1 Wet Laydown (g/m$^2$) | Layers 2 & 3 Wet Laydown (g/m$^2$) | Wet laydown of chill settable layer(s) based on non-chill settable layer |
|---|---|---|---|
| 1 | 73.41 | 47.90 | 65% |
| 2 | 73.41 | 38.21 | 52% |
| 3 | 73.41 | 38.21 | 52% |
| 4 | 73.41 | 29.60 | 40% |

Element 5 was prepared similarly to Element 1, except that chill settable protective Layers 2 and 3 were omitted, and only non-chill settable Layer 1 was coated.

Element 6 was prepared similarly to Element 1, except that it was coated on a support that was not water-absorbing. The resulting coating was full of uniformity defects. The defects were formed on drying due to the difficulty of immobilizing the multiple layers.

Example 3

Rheology of Coating Solutions for Layers 1, 2 & 3

Coating solutions for Layer 1. Layer 2, and Layer 3 used to prepare Element 3 were measured for their chill setting property. A controlled-strain rheometer, Rheometrics ARES Fluids Spectrometer, was used with couette geometry. The geometry has a cup diameter of 34 mm, and a bob diameter and length of 32.4 mm and 33 mm respectively. A sample volume of 12 mL was used. The dynamic viscosity at a frequency of 1 rad.s$^{-1}$ as recorded and the temperature was ramped at 1 c/minute from 45° C. to 5° C. A plot of the log of dynamic viscosity versus linear temperature was generated. The chill setting (gelation) temperature was defined as the temperature that the rate of viscosity change is the highest, i.e., the temperature where the slop is the highest on the log of dynamic viscosity versus linear temperature plot.

The coating solution for Layer 2 has a chill set temperature of 29° C., and the coating solution for Layer 3 has a chill set temperature of 28° C. The coating solution for Layer 1 did not exhibit any chill set behavior; the dynamic viscosity stayed nominally unchanged throughout the enter temperature ramp of 45° C. to 5° C.

Variations of solutions used for Layer 2 in Elements 1, 2, and 4 are expected to have very similar chill set temperature to that of Layer 2 in Element 3.

Example 4

Image Formation Process

All elements were exposed at 35° C. by use of light emitting diodes having a wavelength of 450 nm, 530 nm, and 620 nm. The irradiation energy was varied stepwise so that a step-wedge image was formed. Respective color images (red, green blue, neutral, etc.) were formed by proper combinations of the energy and wavelength of light for exposure.

The recording element having a latent image after the exposure as described above was developed by using a ball processor at a pressure of about 6000 psi, followed by heating for 10 second on a hot plate at 90° C. Finally, the element was irradiated with light for about 10 seconds using a 38 Klux fluorescent lamp. Red, green, and blue optical densities in the maximum exposure area (Dmin) and minimum exposure area (Dmin) were read using a X-Rite densitometer. Gloss in minimum exposure area (black) was measured by Gardner micro-tri-gloss meter at 20-degree angle. The results are tabulated below in Table 1 and Table 2 for a neutral step scale.

TABLE 1

| | Dmax Densities | | | Dmin Densities | | |
|---|---|---|---|---|---|---|
| Example | R/N | G/N | B/N | R/N | G/N | B/N |
| 1 | 1.66 | 1.66 | 1.69 | 0.10 | 0.12 | 0.13 |
| 2 | 1.66 | 1.65 | 1.73 | 0.09 | 0.10 | 0.15 |
| 3 | 1.68 | 1.67 | 1.76 | 0.09 | 0.10 | 0.15 |
| 4 | 1.76 | 1.73 | 1.81 | 0.09 | 0.10 | 0.15 |
| 5 (comparison) | N.A. | N.A. | N.A. | N.A. | N.A. | N.A. |

N.A. = not available

It is noted that Element 5, which did not have protective overcoats (Layer 1 and Layer 2), not only had very low gloss, but was also scratched severely during image processing, thus is not acceptable for customer handling.

TABLE 2

| Element | Gelatin in Layer 2 (g/m$^2$) | Latex in Layer 2 (g/m$^2$) | % latex in Layer 2 | Gloss |
|---|---|---|---|---|
| 1 | 3.23 | 3.23 (LP-1) | 50% | 71.65 |
| 2 | 3.23 | 3.23 (LP-2) | 50% | 63.30 |
| 3 | 4.84 | 1.61 (LP-2) | 25% | 33.30 |
| 4 | 2.15 | 2.15 (LP-2) | 50% | 40.50 |

As is seen in the above tables, as the thickness and the level of latex 2 increases in layer 2, gloss is dramatically improved.

Example 5

Non-Chill Settable Layer Coated Between Chill Settable Layers

Experimentation was performed to investigate the feasibility of coating a non-setting layer between 2 chill settable layers simultaneously. Onto a moving white opaque support (8 mil Granwell Polylith GC2 oriented polypropylene synthetic paper having polyolefin resin coated layers on both sides) that had been previously corona discharge treated, the following layers were coated simultaneously using a slide hopper: a bottom chill-settable gelatin solution layer at a dry coverage of about 2.6 g/m$^2$, a non-settable layer comprising poly(vinyl alcohol) and a poly(methyl acrylate) latex at a ratio of 0.6:1 above the bottom gelatin layer at a dry coverage of about 20 g/m$^2$, a chill settable layer comprising gelatin and a poly(methyl acrylate) latex above the non-settable layer at a dry coverage of about 6 g/m$^2$, and a chill settable gelatin layer above the gelatin/latex layer at a dry coverage of about 1 g/m$^2$. After coating, the layers were set and dried in a similar manner as described in Example 1. The coated layers demonstrated excellent coating quality.

The invention has been described in detail with particular reference to certain preferred embodiments thereof but it will be understood that variations and modifications can be effected within the spirit and scope of the invention.

What is claimed is:

1. A method of coating multiple layers on a support comprising a) taking a support;

b) simultaneously coating on said support a first chill settable layer and a non-chill settable layer, wherein the first chill settable layer is layered on top of the non-chill settable layer;

c) lowering the temperature of the layers to immobilize said layers; and d) drying said layers, wherein the resulting product is an imaging element.

2. The method of claim 1 wherein the temperature is lowered to less than 30° C.

3. The method of claim 1 wherein the temperature is lowered to less than 20° C.

4. The method of claim 1 wherein the temperature is lowered to less than 10° C.

5. The method of claim 1 wherein a second chill settable layer is coated below the non-chill settable layer.

6. The method of claim 5 wherein the second chill settable layer is coated simultaneously with the non-chill settable layer and the first chill settable layer.

7. The method of claim 1 wherein the first chill settable layer comprises gelatin.

8. The method of claim 5 wherein the second chill settable layer comprises gelatin.

9. The method of claim 1 wherein the chill settable layer has a wet laydown thickness greater than 20% of the wet laydown thickness of the non-chill settable layer.

10. The method of claim 1 wherein the first chill settable layer and the non-chill settable layer are simultaneously coated with a multi-slotted slide hopper.

11. The method of claim 1 wherein the support absorbs water or wherein there is an additional layer coated on the support that absorbs water.

12. The method of claim 11 wherein there is an additional water absorbing layer coated on the support, said layer comprising gelatin.

13. The method of claim 1 wherein the non-chill settable layer is porous after drying.

14. The method of claim 1 wherein the first chill settable layer comprises sub-layers.

15. The method of claim 14 wherein chill settable sub-layers have different compositions.

16. The method of claim 15 wherein the chill settable sub-layers form an inner chill settable sub-layer and an outer chill settable sub-layer and wherein the outer chill settable sub-layer has a modulus greater than the modulus of the inner chill settable sub-layer after being coated and dried.

17. The method of claim 16 wherein the inner chill settable sub-layer has a modulus of less than 3 Gpa.

18. The imaging element of claim 16 wherein the outer chill settable sub-layer has a modulus of greater than 3 Gpa.

19. The method of claim 1 wherein the layers are dried at a temperature of less than 50° C.

20. A method of coating multiple layers on a support comprising a) taking a support;

b) simultaneously coating on said support a first chill settable layer and a non-chill settable layer;

c) lowering the temperature of the layers to immobilize said layers; and d) drying said layers, wherein the resulting product is an imaging element and the non-chill settable layer forms an image forming unit comprising photosensitive microcapsules and a developer.

21. The method of claim 20 wherein the imaging element is pressure developable.

* * * * *